US008107637B2

(12) United States Patent
Asada et al.

(10) Patent No.: US 8,107,637 B2
(45) Date of Patent: Jan. 31, 2012

(54) SIGNAL PROCESSING DEVICE AND SIGNAL PROCESSING METHOD

(75) Inventors: Kohei Asada, Kanagawa (JP); Tetsunori Itabashi, Kanagawa (JP); Noriyuki Ozawa, Tokyo (JP)

(73) Assignee: Sony Corporation, Tokyo (JP)

( * ) Notice: Subject to any disclaimer, the term of this patent is extended or adjusted under 35 U.S.C. 154(b) by 434 days.

(21) Appl. No.: 12/431,996

(22) Filed: Apr. 29, 2009

(65) Prior Publication Data

US 2009/0279709 A1 Nov. 12, 2009

(30) Foreign Application Priority Data

May 8, 2008 (JP) ..... 2008-122508

(51) Int. Cl.
*G10K 11/16* (2006.01)

(52) U.S. Cl. ..... 381/71.1; 381/71.6; 381/71.11

(58) Field of Classification Search ..... 381/71.1, 381/71.6

See application file for complete search history.

(56) References Cited

U.S. PATENT DOCUMENTS 5,473,702 A * 12/1995 Yoshida et al. ..... 381/94.7
5,481,615 A * 1/1996 Eatwell et al. ..... 381/71.6
5,668,747 A * 9/1997 Ohashi ..... 708/322
5,699,424 A * 12/1997 Hirano ..... 379/406.11
5,699,436 A * 12/1997 Claybaugh et al. ..... 381/71.6
5,768,124 A * 6/1998 Stothers et al. ..... 700/38
5,774,565 A * 6/1998 Benning et al. ..... 381/83
5,815,582 A * 9/1998 Claybaugh et al. ..... 381/71.6
5,940,519 A * 8/1999 Kuo ..... 381/71.11
5,991,418 A * 11/1999 Kuo ..... 381/71.11
6,041,126 A * 3/2000 Terai et al. ..... 381/71.6
6,198,828 B1 * 3/2001 Kuo ..... 381/71.11
6,418,227 B1 * 7/2002 Kuo ..... 381/71.11
6,418,228 B1 * 7/2002 Terai et al. ..... 381/71.8
6,449,369 B1 * 9/2002 Carme et al. ..... 381/71.12
6,522,753 B1 * 2/2003 Matsuzawa et al. ..... 381/71.1
6,650,756 B1 * 11/2003 Saito et al. ..... 381/71.12
6,683,960 B1 * 1/2004 Fujii et al. ..... 381/71.8
6,711,267 B1 * 3/2004 Kirjavainen ..... 381/71.1
6,741,707 B2 * 5/2004 Ray et al. ..... 381/71.11
6,778,601 B2 * 8/2004 Ise et al. ..... 375/232
6,847,723 B1 * 1/2005 Kiuchi et al. ..... 381/94.7
6,996,241 B2 * 2/2006 Ray et al. ..... 381/71.11
7,881,482 B2 * 2/2011 Christoph ..... 381/103
2003/0026438 A1 2/2003 Ray et al.
2009/0279709 A1 * 11/2009 Asada et al. ..... 381/71.1
2010/0310086 A1 * 12/2010 Magrath et al. ..... 381/71.11

FOREIGN PATENT DOCUMENTS

GB 2441835 A 3/2008

(Continued)

*Primary Examiner* — Elvin G Enad
*Assistant Examiner* — Robert W Horn
(74) *Attorney, Agent, or Firm* — Wolf, Greenfield & Sacks, P.C.

(57) ABSTRACT

A signal processing device includes: a filter processing unit configured to execute noise reduction operations by subjecting sound-collected signals from a sound-collecting unit to filtering processing based on preset filter properties and providing with signal properties for noise reduction; a noise-unreduced signal obtaining unit configured to obtain noise-unreduced signals obtained in a state where noise reduction operations by the filter processing unit are stopped; and a filter property selecting unit configured to obtain a difference between the noise-unreduced signals and noise-reduced signals obtained at the time of executing noise reduction operations with preset filter properties set to the filter processing unit as a candidate filter property, thereby obtaining a noise reduction effect indicator regarding the candidate filter property, and selecting filter properties to be set to the filter processing unit based on the noise reduction effect indicator.

15 Claims, 18 Drawing Sheets

FOREIGN PATENT DOCUMENTS

| | | | |
|---|---|---|---|
| GB | 2445984 | A | 7/2008 |
| JP | 03-096199 | | 4/1991 |
| JP | 03-214892 | | 9/1991 |
| JP | 2000-059876 | | 2/2000 |
| JP | 2007-088521 | A | 4/2007 |
| JP | 2007-240704 | A | 9/2007 |
| JP | 2008-092365 | A | 4/2008 |
| JP | 2008-124564 | A | 5/2008 |

* cited by examiner

FIG. 6

| FILTER PROPERTY No. | FILTER PROPERTY INFORMATION | | | | | | | | | | | | |
|---|---|---|---|---|---|---|---|---|---|---|---|---|---|
| | TYPE OF FILTER 0 | PARAMETERS OF FILTER 0 | | | TYPE OF FILTER 1 | PARAMETERS OF FILTER 1 | | | TYPE OF FILTER 2 | PARAMETERS OF FILTER 2 | | | GAIN |
| | | Fc (Hz) | Q | G (dB) | | Fc (Hz) | Q | G (dB) | | Fc (Hz) | Q | G (dB) | |
| No.0 | MPF | 100.0 | 0.7 | 0.0 | LPF | 100.0 | 0.7 | -1.0 | BPF | 100.0 | 0.7 | -0.2 | 1.3 |
| No.1 | MPF | 100.0 | 0.7 | 0.0 | LPF | 150.0 | 0.7 | -1.0 | BPF | 100.0 | 0.7 | -0.2 | 2.0 |
| ⋮ | ⋮ | ⋮ | ⋮ | ⋮ | ⋮ | ⋮ | ⋮ | ⋮ | ⋮ | ⋮ | ⋮ | ⋮ | ⋮ |
| No.n | MPF | 200.0 | 0.5 | 1.0 | LPF | 200.0 | 0.5 | 0.7 | BPF | 200.0 | 0.5 | 1.0 | 2.0 |

SIGNAL PROCESSING DEVICE AND SIGNAL PROCESSING METHOD

BACKGROUND OF THE INVENTION

1. Field of the Invention

The present invention relates to a signal processing device which performs noise canceling by subjecting sound-collected sound signals from a sound-collecting unit to filtering processing so as to provide signal properties for noise reduction, thereby performing noise canceling operations.

2. Description of the Related Art

There is in practical use a so-called noise canceling system for headphone devices, arranged to actively cancel external noise which can be heard when playing audio contents such as tunes and the like with the headphone devices. Such noise canceling systems can be generally classified into the two methods of the feedback method and the feed-forward method.

For example, Japanese Unexamined Patent Application Publication No. 3-214892 describes the configuration of a noise canceling system having a configuration wherein external noise can be reduced by generating audio signals with inverted phase of noise within a tube mounted to the ears of the user that is sound-collected by a microphone unit provided nearby the earphone (headphone) unit, and outputting this as sound from the earphone unit, i.e., a noise canceling system configuration corresponding to the feedback method.

Also, Japanese Unexamined Patent Application Publication No. 3-96199 describes a basic configuration wherein audio signals obtained by sound-collecting with a microphone attached to an outer housing of a headphone device are provided with a predetermined transfer function and output from the headphone device, i.e., a noise canceling system configuration corresponding to the feed-forward method.

In employing either of the feed-forward method or feedback method, filter properties set for noise canceling are set such that noise is canceled (reduced) at the ear position of the user, based on spatial transfer functions regarding audio from an external noise source arriving at the ear position of the user (noise cancellation point), properties of electrical parts such as microphone amp, headphone amp, and so forth and further, various types of transfer functions such as properties of acoustic parts such as microphone, driver unit (speaker), and so forth for example.

SUMMARY OF THE INVENTION

Now, with acoustic parts, of which so called transducers like the above drivers and microphones are representative, the mechanical configuration thereof directly affects functions and capabilities, and influence due to irregularities thereof is relatively great as compared with electrical parts. Accordingly, when irregularities occur in acoustic parts among individual headphones, the difference in acoustical perception is significant, even among headphones of the same model. Particularly, with noise canceling headphones, noise canceling filtering properties are set such that proper noise canceling effects can be obtained including the transfer properties of these acoustic parts as well, as described above, so there are cases wherein irregularities in acoustic parts may lead to irregularities in noise canceling effects, such that sufficient noise canceling effects may not be obtainable.

Another problem regarding irregularities that can be listed is one occurring due to the shape of the ears of the user, and how the user wears the headphones. Such individual differences among user may also lead to irregularities in noise canceling effects.

With the related art, such irregularities in acoustic parts have been dealt with by a technique wherein multiple potentiometers are used on the manufacturing line or the like for example, so as to change gain and rough NC filter properties, whereby property compensation is performed.

However, such measures according to the related art involve manpower, leading to increased labor costs, and further increase in device manufacturing costs. Also, fine property compensation is difficult with adjustment using potentiometers as described above, and it has been difficult to realize sufficient improvement.

Also, adjustment prior to shipping does not compensate for differences between individual users, unlike with acoustic parts. Even if the user were to perform such manual adjustment, this is problematic in that the burden of labor is forced on the individual user.

According to an embodiment of the present invention, a signal processing device includes: a filter processing unit configured to execute noise reduction operations by subjecting sound-collected signals from a sound-collecting unit to filtering processing, based on preset filter properties, and providing with signal properties for noise reduction; a noise-unreduced signal obtaining unit for obtaining noise-unreduced signals obtained in a state where noise reduction operations by the filter processing unit are stopped; and a filter property selecting unit for obtaining a difference between the noise-unreduced signals and noise-reduced signals obtained at the time of executing noise reduction operations with preset filter properties set to the filter processing unit as a candidate filter property, thereby obtaining a noise reduction effect indicator regarding the candidate filter property, and selecting filter properties to be set to the filter processing unit based on the noise reduction effect indicator.

According to the above configuration, a noise reduction effect indicator regarding the candidate filter property is actually measured from a difference between noise-unreduced signals obtained in a state where noise reduction operations are off, and noise-reduced signals at the time of executing noise reduction operations with a preset candidate filter property. Filter properties to be set to the filter processing unit can be selected based on the actually-measured noise reduction effect indicator.

Performing selection of filter properties based on actually-measured noise reduction effect indicators enables appropriate filter property selection, in accordance with irregularities in acoustic parts making up the headphone, the shape of the ears of the user, and the way in which the user wears the headphones. That is to say, an appropriate filter property can be selected capable of performing property compensation regarding irregularities in acoustic parts and differences among individual users.

As described above, with the present invention, performing filter property selection based on actually measured noise reduction effect indicators enables appropriate filter property selection, which can perform property compensation regarding irregularities in acoustic parts and differences among individual users.

Thus, adjustment by manual labor for property compensation before shipping, as has been done with the related art, does not have to be performed, whereby labor costs, and accordingly manufacturing costs, can be reduced. Also, this is not manual labor adjustment using potentiometers and the like, so finer adjustment can be performed. Also, the individual user does not have to perform the work of manual adjustment, thereby realizing an excellent noise canceling system where a load is not placed on the user in this point.

BRIEF DESCRIPTION OF THE DRAWINGS

FIGS. 1A and 2B are diagrams illustrating a model example of a noise canceling system of a headphone device using the feedback method;

FIG. 6 is a diagram illustrating a data configuration example of a filter property information database;

DESCRIPTION OF THE PREFERRED EMBODIMENTS

Embodiments of the present invention will be described with reference to the drawings. First, before describing the configuration of embodiments of the present embodiment, the basic concept of a noise canceling system will be described.

Concept of Noise Canceling System

Examples of basic methods for noise canceling systems according to the relate art include an arrangement wherein servo control is performed by a feedback (hereinafter may be abbreviated to "FB") method, and also a feed-forward (hereinafter may be abbreviated to "FF") method. First, the FB method will be described with reference to FIGS. 1A and 1B.

Figure 1B:
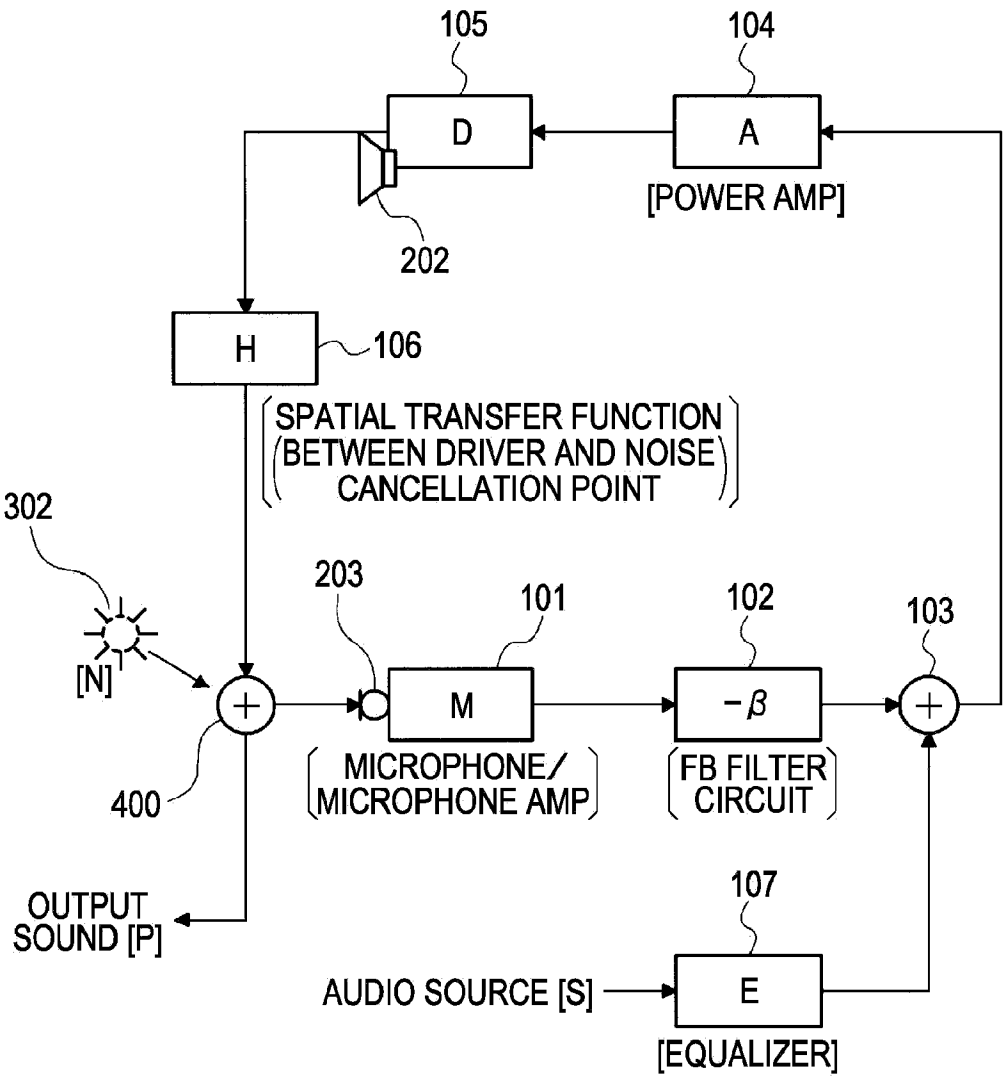
Figure 1A:
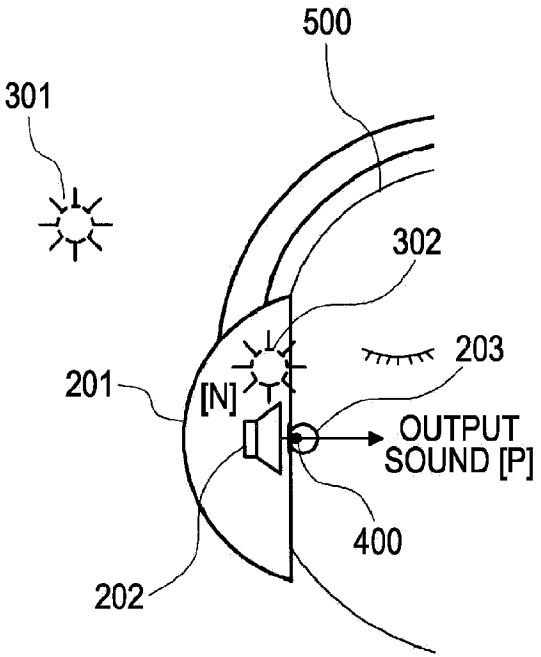

FIG. 1A schematically illustrates a model example of an FB method noise canceling system, at the right ear (the R channel of two-channel stereo of L (left) and R (right)) side of the headphone wearer (user). As for the structure of the headphone device at the R channel side, first, a driver 202 is provided within a housing unit 201, at a position corresponding to the right ear of a user 500 wearing the headphone device. The driver 202 is the same as a so-called speaker having a diaphragm, and emits sound into the air by being driven by amplified output of audio signals.

With this in mind, with the FB method, a microphone 203 is provided within the housing 201 as to a position which is considered to be near the right ear of the user 500. This microphone 203 sound-collects audio output from the driver 202, and audio entering the housing unit 201 from an external noise source 301 and traveling toward the right ear, i.e., in-housing noise 302 which is external audio heard by the right ear. Note that examples of causes of in-housing noise 302 occurring include the noise source 301 leaking in from a gap in the ear pad of the housing unit as acoustic pressure for example, the housing of the headphone device itself vibrating under the acoustic pressure of the noise source 301, which is transmitted into the housing, and so forth.

Signals for canceling (attenuating, reducing) the in-housing noise 302 (canceling audio signals), such as signals having inverse properties as to the audio signal components of the external audio, are generated from the audio signals obtained by sound-collecting with the microphone 203, and these signals are fed back so as to be synthesized with the audio signals of listening sound (audio source) for driving the driver 202. Thus, at a noise cancellation point 400 set at a position corresponding to the right ear within the housing unit 201, sound is obtained wherein external audio has been cancelled by the output audio from the driver being synthesized with the external audio component, and the right ear of the user hears this sound. Such a configuration is provided at the L channel (left ear) side as well, thereby obtaining a noise canceling system for a headphone device corresponding to normal two-channel stereo of the R and L channels.

The block diagram in FIG. 1B illustrates a basic model configuration example of an FB method noise canceling system. Note that in FIG. 1B, a configuration is shown only corresponding to the R channel (right ear) in the same way as with FIG. 1A, and the same system configuration is provided corresponding to the L channel (left ear). Also, the blocks illustrated in this drawing illustrate a particular transfer function corresponding to a particular circuit member, circuit system, or the like, in an FB method noise canceling system, and will be referred to as transfer function blocks here. The words shown next to each transfer function block represent the transfer function of that transfer function block, and audio signals (or audio) are provided with the transfer function shown thereat, upon passing through the transfer function block.

First, the audio sound-collected by the microphone 203 provided within the housing unit 201 is obtained as audio signals via the microphone 203, and a transfer function block 101 (transfer function M) corresponding to an microphone amp which amplifies electric signals obtained at the microphone 203 and outputs audio signals. The audio signals which have passed through the transfer function block 101 are input to a synthesizer 103 via a transfer function block 102 (transfer function $-\beta$) corresponding to an FB filter circuit. The FB filter circuit is a filter circuit in which properties have been set so as to generate the above-described canceling audio signals from the audio signals obtained by sound-collecting with the microphone 203, and the transfer function thereof is written as $-\beta$.

Also, audio signals S from an audio sound source, which may be music or the like, have been subjected to equalizing by an equalizer here, and are input to a synthesizer 13 via a transfer function block 107 (transfer function E) corresponding to this equalizer.

Note that the audio signals S are subjected to such equalizing that with the FB method, the noise sound- collecting microphone 203 is provided within the housing unit 201, and sound-collects not only noise sound but also the output audio from the driver 202. That is to say, with the FB method, the transfer function −β is also provided to the audio signals S, due to the microphone 203 sound-collecting the component of the audio signals S as well, and may lead to deterioration in sound quality of the audio signals S. Accordingly, the audio signals S are provided with predetermined signal properties by equalizing in order to suppress deterioration in sound quality due to the transfer function −β, beforehand.

The synthesizer 103 synthesizes the above two signals by addition. The audio signals thus synthesized are amplified by a power amp, and output to the driver 202 as driving signals, so as to be output from the driver 202 as audio signals. That is to say, the audio signals from the synthesizer 103 pass through the transfer function block 104 (transfer function A) corresponding to the power amp, and further pass the transfer function block (transfer function D) corresponding to the driver 202, and are emitted into the air as audio. Note that the transfer function D of the driver 202 is determined in accordance with the structure and the like of the driver 202, for example.

The audio output at the driver 202 reaches the noise cancellation point 400 via a transfer function block 106 (transfer function H) corresponding to the spatial path (spatial transfer function) from the driver 202 to the noise cancellation point 400, and is synthesized with the in-housing noise 302 in the space thereat. The acoustic pressure P of the output sound reaching the right ear, for example, from the noise cancellation point 400, has had the sound of the noise source 301 intruding externally from the housing unit 201 cancelled out.

Now, in the noise canceling system model system shown in FIG. 1B, the above-described acoustic pressure P of the output sound is expressed as in the following Expression 1, with the in-housing noise 302 as N, and the audio signals of the audio sound source as S, using the transfer functions "M, −β, E, A, D, H" in the respective transfer function blocks.

[Expression 1]

$$P = \frac{1}{1 + ADHM\beta}N + \frac{AHD}{1 + ADHM\beta}ES \qquad \text{[Expression 1]}$$

Taking note of N which is the in-housing noise 302 in this Expression 1, we can see that N is attenuated by a coefficient expressed by 1/(1+ADHMβ).

However, in order for this system according to Expression 1 to operate stably without oscillating at the frequency bandwidth for noise reduction, the following Expression 2 must hold.

[Expression 2]

$$\left|\frac{1}{1 + ADHM\beta}\right| < 1 \qquad \text{[Expression 2]}$$

As a general matter, combining the fact that the absolute value of the product of the transfer functions in the FB method noise canceling system is expressed by $$1 \ll |ADHM\beta|$$

and the Nyquist stability determination in classical control theory, Expression 2 can be interpreted as follows.

Here, we will consider a system expressed by (−ADHMβ), obtained in the noise canceling system shown in FIG. 1B by cutting one portion of the loop portion relating to N which is the in-housing noise 302. This system will be referred to as an "open loop" here. As one example, the aforementioned open loop can be formed by setting between the transfer function block 101 corresponding to the microphone and microphone amp, and the transfer function block 102 corresponding to the FB filter circuit, as the portion to be cut.

Figure 2:
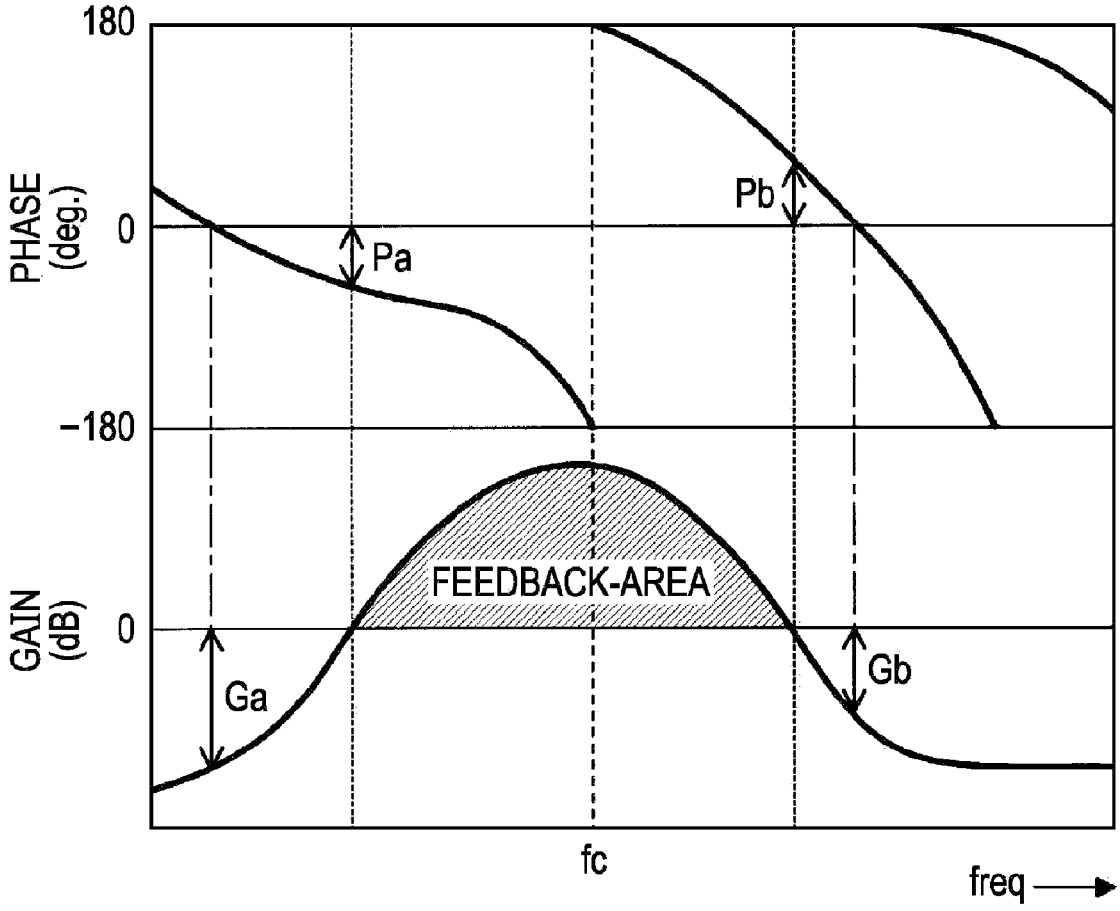
FIG. 2 is Bode plot illustrating properties of the noise canceling system shown in FIGS. 1A and 1B.

This open loop is understood to have properties indicated by the Bode plot in FIG. 2, for example. In this Bode plot, the horizontal axis represents frequency, and the vertical axis represents gain at the lower half and phase at the upper half.

In the case of dealing with the open loop herein, the two following conditions must be satisfied in order to satisfy Expression 2, based on the Nyquist stability determination.

Condition 1: At the time of passing through the point of phase 0 deg. (0 degrees), the gain must be lower than 0 dB.

Condition 2: At the time that gain is 0 dB or higher, the point of phase 0 deg. must not be included.

In the event that the two conditions 1 and 2 are not satisfied, the loop exhibits positive feedback, resulting in oscillation (howling). In FIG. 2, the phase margins Pa and Pb corresponding to the above Condition 1, and the gain margins Ga and Gb corresponding to Condition 2, are shown. If these margins are small, the possibility of oscillation occurring increases, due to various types of individual differences of the user using the headphone device to which the noise canceling system has been applied, and differences in the state of wearing the headphone device.

For example, in FIG. 2, the gain at the time of passing through the point of phase 0 deg., is smaller than 0 dB, and accordingly gain margins Ga and Gb are obtained. However, if the gain at the time of passing through the point of phase 0 deg. is 0 dB or greater such that the gain margins Ga and Gb are not obtained, or the gain at the time of passing through the point of phase 0 deg. is smaller than 0 dB but close to 0 dB and accordingly gain margins Ga and Gb are small, oscillation occurs, or the possibility of oscillation increases.

In the same way, in FIG. 2, in the event that the gain is 0 dB or higher, the point of phase 0 deg. is not passed through, thereby obtaining phase margins Pa and Pb. However, in the event that the gain is 0 dB or higher but the point of phase 0 deg. is passed through, or is close to the point of phase 0 deg. and the phase margins Pa and Pb are small, oscillation occurs, or the possibility of oscillation increases.

Next, a case of reproducing and outputting listening sound from the headphone device, in addition to the canceling (reduction) function of external audio (noise) described above, with the configuration of the FB noise canceling system shown in FIG. 1B, will be described.

Here, audio signals S of the audio source which are contents such as music for example, are shown as listening sound.

Note that others may be conceived for the audio signals S besides musical or like contents. For example, in a case of applying the noise canceling system to a hearing aid for example, these are audio signals sound-collected by a microphone (different from the microphone 203 provided to the noise canceling system) provided externally to the housing for sound-collecting the ambient listening sound. Also, in the case of applying to a so-called headset, these are audio signals such as the speech of the other part received by communication such as telephone communication. That is to say, the audio signals S correspond to audio in general which should be reproduced and output in accordance with the user of the headphone device.

First, let us take note of the audio signals S of the audio source in the above Expression 1. We will further say that we set the transfer function E corresponding to the equalizer as that having the properties expressed in the following Expression 3.

$$E=(1+ADHM\beta) \quad \text{[Expression 3]}$$

[Expression 3]

Note that the transfer properties E Are approximately inverse properties as to the above open loop when viewed by frequency axis (1+open loop properties). Substituting the expression of the transfer function E shown in Expression 3 into Expression 1 allows us to express the acoustic pressure P of the output sound in the noise canceling system model shown in FIG. 1B as in the following Expression 4.

[Expression 4]

$$P=\frac{1}{1+ADHM\beta}N+ADHS \quad \text{[Expression 4]}$$

Of the transfer functions A, D, and H shown in the item ADHS in Expression 4, the transfer function A corresponds to the power amp, the transfer function D corresponds to the driver 202, and the transfer function H corresponds to the spatial transfer function of the path from the driver 202 to the noise cancellation point 400, so if the position of the microphone 203 within the housing unit 201 is in close proximity to the ear, the audio signals S can be understood to yield properties equivalent to a normal headphone not having noise canceling functions.

Next, a noise canceling system according to the FF method will be described. FIG. 3A illustrates the configuration at the side corresponding to the R channel, as with FIG. 1A above, as a model example of a FF method noise canceling system.

With the FF method, the microphone 203 is provided to the outer side of the housing unit 201, so as to sound- collect audio arriving from the noise source 301. The external audio sound-collected with the microphone 203, i.e., the audio arriving from the noise source 301 is sound-collected and audio signals are obtained, these audio signals are subjected to suitable filtering processing, and thus canceling audio signals are generated. These canceling audio signals are then synthesized with the audio signals from the listening sound. That is to say, canceling audio signals which electrically simulate the acoustic properties from the position of the microphone 203 to the position of the driver 202 are synthesized as to the audio signals of the listening sound.

Outputting audio signals where the canceling audio signals and the audios signals of the listening sound are synthesized, from the driver 202, results in the sound obtained at the noise cancellation point 400 sounding as if the sound intruding into the housing unit 201 from the noise source 301 has been cancelled out.

Figure 3B:
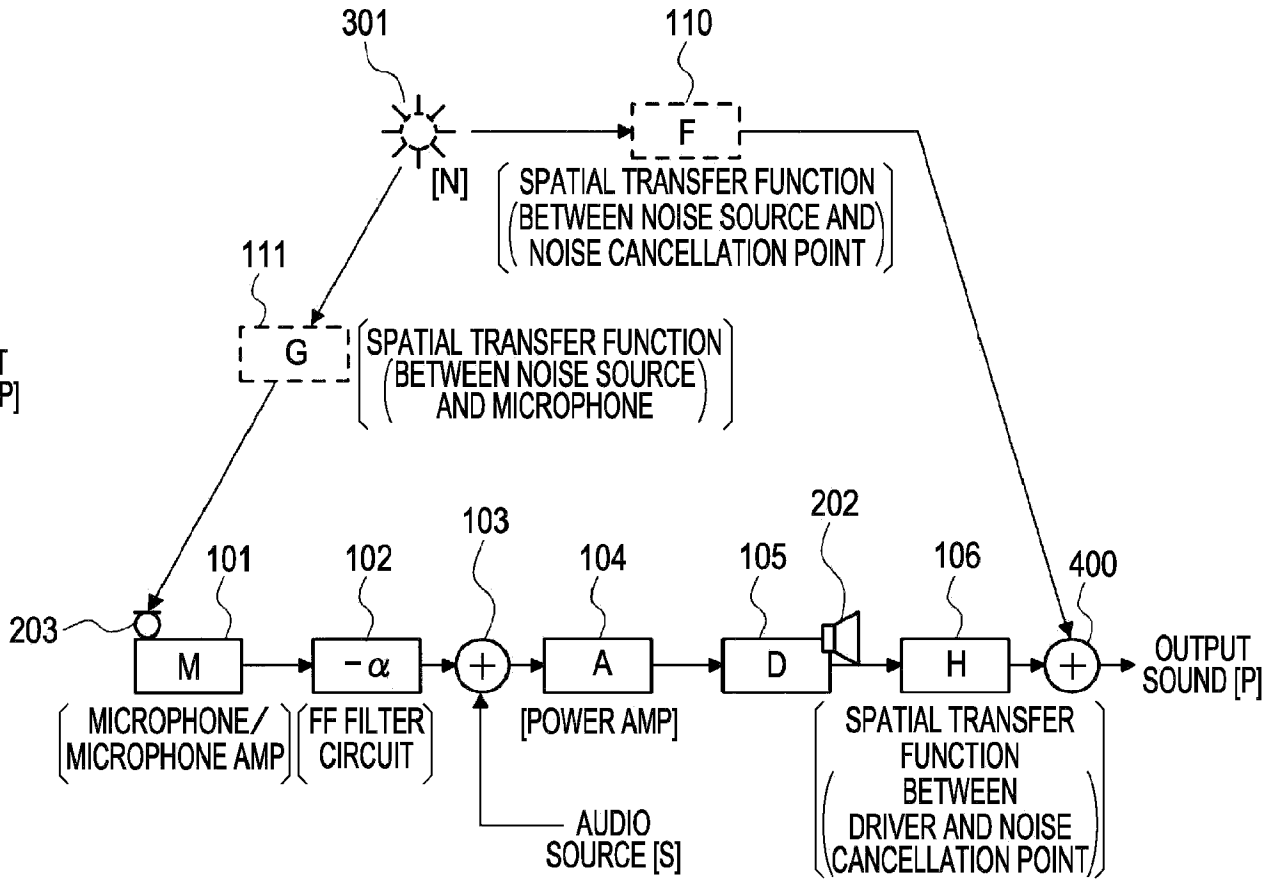
FIGS. 3A and 3B are diagrams illustrating a model example of a noise canceling system of a headphone device using the feed-forward method.
Figure 3A:
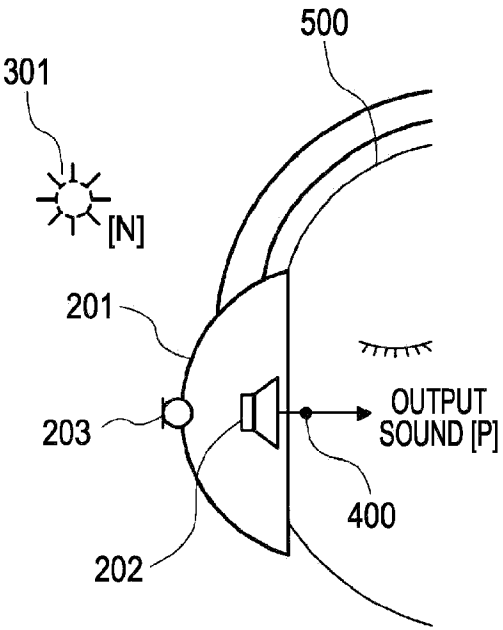

FIG. 3B illustrates a configuration of the side corresponding to one channel (R channel) as a basic model configuration example of an FF method noise canceling system. First, the sound-collected by the microphone 203 provided on the outer side of the housing unit 201 is obtained as audio signals via the noise canceling transfer function block 101 having the transfer function M corresponding to the microphone 203 and microphone amp.

Next, the audio signals which have passed through the transfer function block 101 are input to the synthesizer 103 via a transfer function block 102 (transfer function $-\alpha$) corresponding to an FF filter. The FF filter circuit 102 is a filter circuit where properties have been set for the canceling audio signals from the audio signals obtained by sound-collecting with the microphone 203, and the transfer function thereof is expressed as $-\alpha$. Also, the audio signals S of the audio sound source here are directly input to the synthesizer 103.

The audio signals synthesized by the synthesizer 103 are amplified by the power amp, and output to the driver 202 as driving signals, so as to be output as audio from the driver 202. That is to say, in this case as well, the audio signals from the synthesizer 103 pass through the transfer function block 104 (transfer function A) corresponding to the power amp, and further pass through the transfer function block 105 (transfer function D) corresponding to the driver 202, to be emitted into the air as audio.

The audio output at the driver 202 reaches the noise cancellation point 400 via the transfer function block 106 (transfer function H) corresponding to the spatial path (spatial transfer function) from the driver 202 to the noise cancellation point 400, and is synthesized with the in-housing noise 302 in the space thereat.

Also, between being emitted from the noise source 301 till intruding into the housing unit 201 and reaching the noise cancellation point 400, the sound is provided with a transfer function corresponding to the path from the noise source 301 to the noise cancellation point 400 (spatial transfer function F) as shown as transfer function block 110. On the other hand, audio arriving from the noise source 301 which is external audio, is sound-collected at the microphone 203, and at this time, the sound emitted from the noise source 301 is provided with a transfer function corresponding to the path from the noise source 301 to the microphone 203 (spatial transfer function G) as shown as transfer function block 111. With the FF filter circuit corresponding to the transfer function block 102, the transfer function $-\alpha$ is set taking the spatial transfer functions F and G into consideration as well.

Accordingly, with the sound pressure P of the output sound reaching the right ear, for example, from the noise cancellation point 400, the sound of the noise source 301 intruding externally from the housing unit 201 is cancelled out.

Now, in the noise canceling system model system shown in FIG. 3B, the above-described acoustic pressure P of the output sound is expressed as in the following Expression 5, with the noise omitted at the noise source 301 as N, and the audio signals of the audio sound source as S, using the transfer functions "M, $-\alpha$, E, A, D, H" in the respective transfer function blocks.

$$P=-GADHM\alpha N+FN+ADHS \quad \text{[Expression 5]}$$

[Expression 5]

Also, ideally, the transfer function F of the path from the noise source 301 to the cancel point 400 can be expressed as in the following Expression 6.

$$F=GADHM\alpha \quad \text{[Expression 6]}$$

[Expression 6]

Next, substituting Expression 6 into Expression 5, the first item and second item of the right side are cancelled out. From the result thereof, the acoustic pressure P of the output sound can be expressed as with the following Expression 7.

$$P=ADHS \quad \text{[Expression 7]}$$

[Expression 7]

Thus, the sound arriving from the noise source 301 is cancelled, and just the audio signals of the audio sound source are obtained. That is to say, logically, audio of which the noise has been cancelled is heard at the right ear of the user. However, in reality, configuration of a perfect FF filter circuit which can provide transfer functions such that Expression 6 perfectly holds is extremely difficult. Also, individual differences, such as the shape of ears from one person to another, and the way in which the headphone device is worn, are relatively great, and change in the relation between the position at which noise is generated and the microphone position and so forth affect noise reduction effects in the mid-to-high range frequency bands in particular, a point which is widely recognized. Accordingly, often active noise reduction processing is refrained from with regard to the mid-to-high band, and primarily passive sound isolation dependent on the structure of the housing of the headphone device is performed.

Also, it should be noted that Expression 6 implies simulating the transfer function from the noise source 301 to the ear with an electrical circuit including the transfer function $-\alpha$.

Also, with the FF method noise canceling system shown in FIG. 3A, the microphone 203 is provided to the outer side of the housing, so the cancellation point 400 can be arbitrarily set as to the housing unit 201 so as to correspond to the position of the ear of the listener, unlike the FB system noise canceling system in FIG. 1A. However, normally, the transfer function $-\alpha$ is fixed, and some sort of target properties has to be set as an object. On the other hand, the shapes and so forth of the ears of listeners differ. Accordingly, there may be cases wherein sufficient noise cancellation effects are not obtained, or the noise be added at non-inverse phase, resulting in a phenomenon of creation of abnormal sound.

Accordingly, generally with the FF method, the possibility of oscillation is low and stability is high, but it is considered to be difficult to obtain sufficient noise attenuation amount (cancellation amount). On the other hand, while great noise attenuation amount can be expected with the FB method, it is said that care has to be taken regarding the stability of the system. Thus, the FB method and FF method have respective characteristics. First Embodiment (Example of Application to FB Method)

Configuration of Headphone Device

Figure 4:
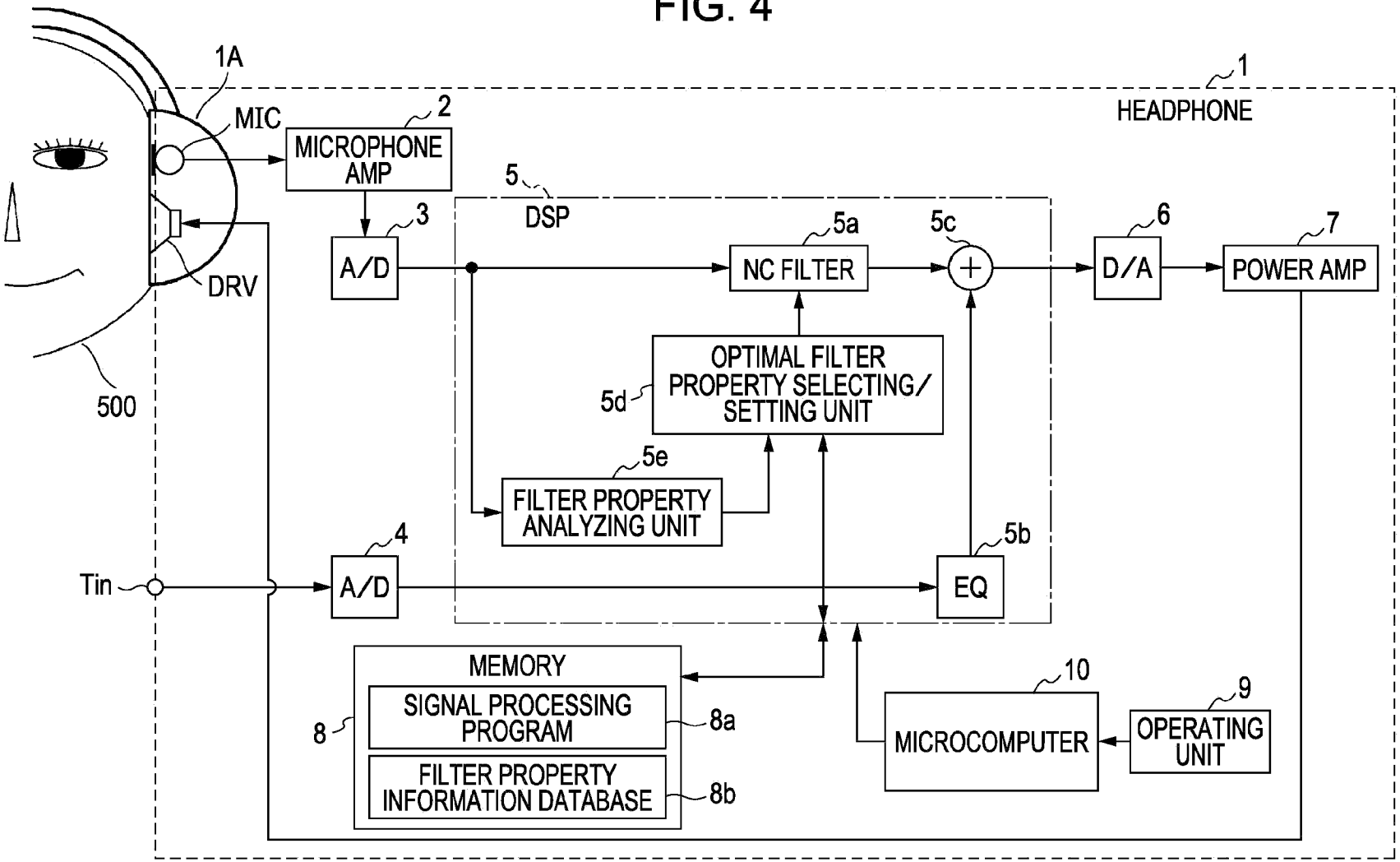
FIG. 4 is a block diagram illustrating the internal configuration of a signal processing device serving as a first embodiment.

FIG. 4 is a block diagram illustrating the internal configuration of a headphone device 1 serving as an embodiment of the signal processing device according to the present invention.

First, the headphone 1 is provided with a microphone MIC as a configuration corresponding to the noise canceling system. As shown in the drawing, audio signals sound-collected by the microphone MIC are amplified at a microphone amp 2, converted into digital signals at an A/D converter 3, and supplied to a DSP (Digital Signal Processor) 5. Note that sound-collected signals converted into digital signals at the A/D converter 3 will also be called sound-collected data.

Now, the headphone 1 shown in FIG. 4 employs the FB method as the noise canceling method. As can be seen by referring to the above-described FIG. 1A, with a headphone device corresponding to the FB method, the microphone MIC (the microphone 203 in FIGS. 1A and 1B) is provided so as to be disposed on the inner side of the housing unit (201 in FIGS. 1A and 1B). Specifically, the microphone MIC in this case is provided so as to sound-collect the output audio from a driver DRV along with the in-housing noise (302 in FIGS. 1A and 1B) in a housing unit 1A which the headphone 1 has.

Now, it should be noted that the present invention is also applicable in a case of employing the FF method as the noise canceling method, but to avoid confusion, here, a case wherein the FB method is employed will be described first, and a case of employing the FF method will be described later as a second embodiment.

Also, in FIG. 4, the headphone 1 is provided with an audio input terminal Tin, provided for input of audio signals supplied from an external audio player or the like, for example. Audio signals input from the audio input terminal Tin are supplied to the DSP 5 via the A/D converter 4.

Now, it should be noted that the headphone 1 operates to cause the wearer of this headphone 1 to hear audio based on the audio signals input from the audio input terminal Tin, and also to cancel (reduce) noise sound. That is to say, the audio signals input from the audio input terminal Tin are audio signals for listening, to be input for listening by the user. In other words, these are audio signals which are not the object of noise canceling.

The DSP 5 realizes the operations as the function blocks shown in the drawing by executing digital signal processing based on a signal processing program 8*a* stored in memory 8 in the drawing.

Here, the function blocks of the DSP 5 may be handled as hardware hereinafter, for the sake of description. Also, in the following noise canceling may be abbreviated to "NC".

Also, in FIG. 4, both function blocks corresponding to the above-described normal operations, and function blocks corresponding to selection/setting of optimal filters in a later-described embodiment (calibration regarding NC filter properties), are shown with regard to the functions which the DSP 5 has. Specifically, the function blocks corresponding to the normal operation are an NC filter 5*a*, equalizer (EQ) 5*b*, and adding unit 5*c*. In the following description, description will be made regarding only the function blocks corresponding to such normal operations, and function blocks corresponding to calibration will be handled as non-existent. The function blocks corresponding to calibration will be described later.

First, the sound-collected data input to the DSP 5 via the above-described A/D converter 3 are supplied to the NC filter 5*a*. The NC filter 5*a* provides signal properties for noise canceling by subjecting the sound-collected data to filtering processing with predetermined filter properties.

Now, the memory 8 connected to the DSP 5 stores multiple sets of filter property information for obtaining noise canceling properties which differ one from another. Each filter property information set is information for setting the filter properties of the NC filter 5*a*, and specifically, these are filter configurations and various types of parameter information for determining the filter properties of the NC filter 5*a*.

Figure 5:
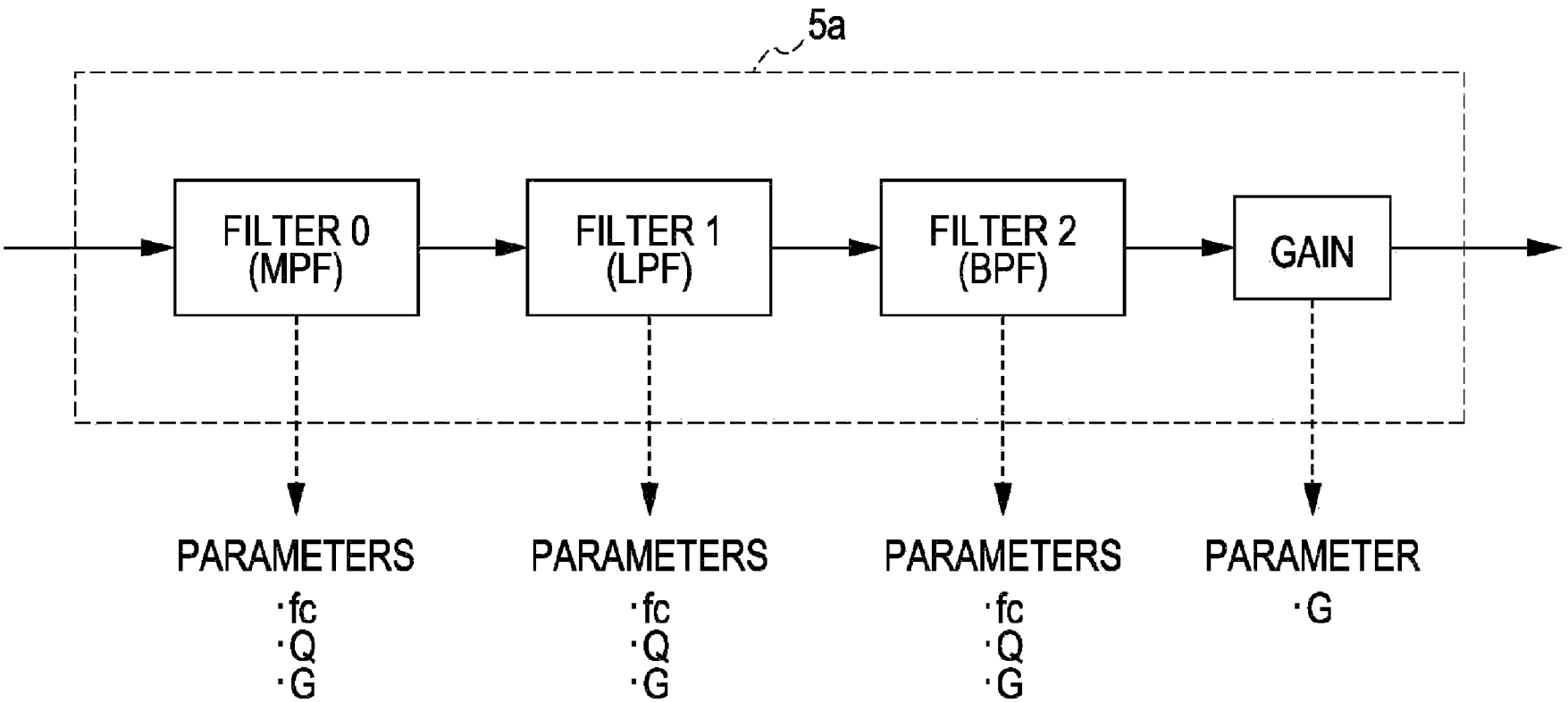
FIG. 5 is a diagram illustrating an example of the filter configuration of an NC filter.

FIG. 5 illustrates an example of a filter configuration of an NC filter 5*a*. With the configuration example shown in FIG. 5, the NC filter 5*a* is shown as being configured of a serial connection of Filter 0→Filter 1→Filter 2 followed by a multiplier for performing gain adjustment. In this case, the Filter 0 is an MPF (Mid Presence Filter), the Filter 1 is an LPF (Low Pass Filter), and the Filter 2 is a BPF (Band Pass Filter). Adjustable parameters for each of the MPF, LPF, and BPF are cutoff frequency (center frequency) fc, Q value, and gain G, as shown in the drawing. Also, the parameter of the multiplier is gain G.

Note that the filter configuration example of the NC filter 5*a* shown in FIG. 5 is only an illustration of one filter configuration example corresponding to the setting state of certain filter properties, and does not mean that the number of filters or filter types formed are restricted to those shown in the drawing, for example. Accordingly, in actual practice, the configurations for obtaining the individual NC properties are variably set as each of the filter properties, and the number of filters, filter types, the connection form of the filters, and so on, for example, do not necessarily match that shown in FIG. 5.

However, to facilitate description below, we will say that components of change in the filter configuration of the NC filter 5*a* have the following conditions.

Only a serial connection form such as shown in FIG. 5 is employed for the connection form of multiple filters.

Only the number of filters combined, the type of the filters combined, the parameters of the filters, and the parameter of the multiplier (gain G=0 is permissible) may be changed.

The parameters of the filters are only cutoff frequency (center frequency) fc, Q value, and gain G.

FIG. 6 illustrates a data structure example of a filter property information database 8*b* corresponding to a case of the above conditions, as a data structure example of the filter property information database 8*b*.

As shown in FIG. 6, each of multiple sets of filter property information for obtaining noise canceling properties which differ one from another are numbered by corresponding filter property Nos.

As shown in the drawing, the filter property information in this case is information combining information of the types of Filter 0 through Filter 2, individual parameter information (fc, Q, G) of each of Filter 0 through Filter 2, and gain information of the above-described multiplier.

Note that for the information of the type of Filter 1 and parameters of Filter 1, and the information of the type of Filter 2 and parameters of Filter 2, no valid information is stored if no filters are provided in the respective filter positions.

Returning to FIG. 4, at the DSP 5, the equalizer 5*b* subjects the listening audio signals (audio data) input via the above-described A/D converter 4 to equalizing processing. For example, the equalizer 5*b* can be realized by a FIR (Finite Impulse Response) filter or the like.

As can be understood from the earlier description of the basic concept, with the FB method, there may be deterioration in the audio quality of audio signals (listening audio signals) added to the feedback loop, in conjunction with filtering processing being performed for noise canceling in the feedback loop. The functional operations as the equalizer 5*b* are to prevent such deterioration in the audio quality of listening audio signals beforehand.

The adding unit 5*c* adds the audio data subjected to equalizing by the equalizer 5*b*, and the sound-collected data provided with signal properties for noise canceling by the NC filter 5*a* as described above. The data obtained by this adding unit 5*c* is called added data. The added data includes components of sound-collected data to which signal properties for noise canceling by the NC filter 5*a* have been provided. Accordingly, performing acoustic reproduction based on the added data at the driver DRV causes the user wearing the headphone 1 to sense that the noise component has been cancelled (reduced). That is to say, audio other than audio based on the listening audio signals is cancelled for listening.

The added data obtained at the DSP 5 in this way is supplied to a D/A converter 5 and converted into analog signals, and subsequently amplified at a power amp 7 and supplied to the driver DRV.

The driver DRV has a diaphragm, and the diaphragm is configured so as to be driven based on the audio signals (driving signals) supplied form the power amp 7, thereby performing audio output (acoustic reproduction) based on the audio signals.

A microcomputer 10 is configured including, for example, ROM (Read Only Memory), RAM (Random Access Memory), a CPU (Central Processing Unit), and so forth and performs overall control of the headphone 1 by performing various types of control processing and computation based on a program stored in the ROM for example.

As shown in the drawing, an operating unit 9 is connected to the microcomputer 10. The operating unit 9 is configured having operating elements not shown in the drawing, provided so as to be present on the outer face of the housing of the headphone 1 for example, whereby the user performs various types of operation input. The information input at the operating unit 9 is transferred to the microcomputer 10 as operation input information. The microcomputer 10 performs appropriate computation and control corresponding to the input information.

For example, an example of an operating element provided to the operating unit 9 is a power button for instructing on/off of the power of the headphone 1. The microcomputer 10 performs power on/off control of the headphone 1, based on the operation input information supplied from the operating unit 9 in accordance with operation of the power button.

Also, an example of an operating element provided to the operating unit 9 is an instruction button for instructing starting of later-described calibration operations. The microcomputer 10 gives operation start instructions to the DSP 5 (a later-described optimal filter property selecting/setting unit 5*d*), based on the operation input information supplied from the operating unit 9 in accordance with operation of the instruction button.

Calibration Operation

Now, with acoustic parts, of which so-called transducers like the driver DRV and microphone MIC and the like are representative, the acoustic properties affect the noise canceling effects relatively greatly. However, the acoustic properties of these acoustic parts are greatly influenced by the precision of the mechanical configuration thereof, so thereby be irregularities between each individual unit. That is to say, there is a possibility that such irregularities may cause irregularities in noise canceling effects as well, and in some cases, sufficient noise canceling effects may not be obtainable.

Another problem that can be listed as relating to irregularities is the problem due to the ear shapes of users, and the way of wearing (wearing state) of the headphones by the user. That is to say, irregularities may occur in the noise canceling effects due to such individual differences of users, as well.

Such irregularities in acoustic parts have been dealt with by a technique wherein multiple potentiometers are used on the manufacturing line or the like for example, so as to change gain and rough NC filter properties, whereby property compensation is performed.

However, such measures according to the related art involve manpower, leading to increased labor costs, and further increase in device manufacturing costs. Also, fine property compensation is difficult with adjustment using potentiometers as described above, and it has been difficult to realize sufficient improvement.

Also, adjustment prior to shipping does not compensate for differences between individual users, unlike with acoustic parts. Even if the user were to perform such manual adjustment, this is problematic in that the burden of labor is forced on the individual user.

Accordingly, with the present embodiment, a technique of performing calibration for filter properties set for the NC filter 5*a* is employed, so as to absorb irregularities in these acoustic parts and irregularities due to individual difference between users.

Figure 7:
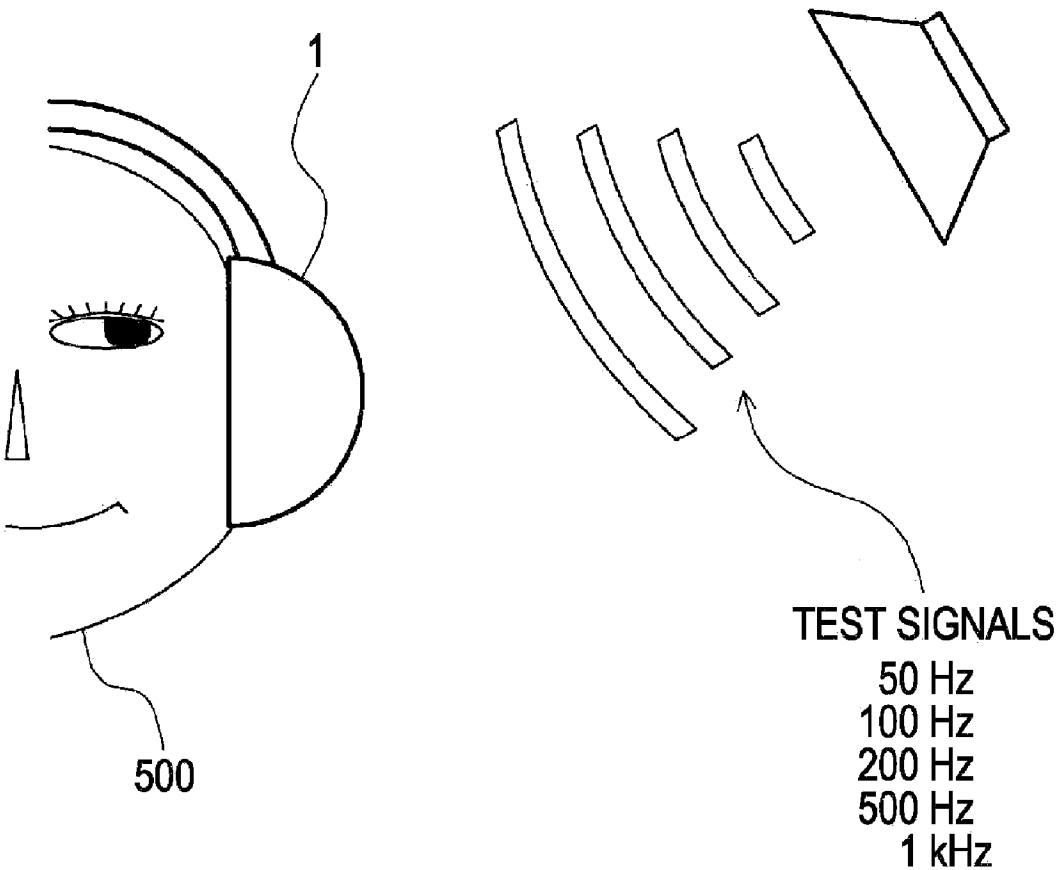
FIG. 7 is a diagram exemplarily illustrating an analyzing environment in a case of executing calibration operations at the user side.

First, in a case of performing calibration operations as the present embodiment, a prerequisite is placing the headphone 1 in an analysis environment such as shown in FIG. 7. As shown in FIG. 7, in the case of performing calibration operations, the headphone 1 is worn by the user 500. In this state, the user 500 outputs test signals with a hand-held acoustic reproduction device or the like, for example. In this case, a signal recording medium such as a CD (Compact Disc) recording test signals beforehand is distributed to the user 500 (e.g., by packaging the signal recording medium with the headphone 1 which is a product), and test signals are output by acoustic reproduction of the signals recorded in the signal recording medium with an acoustic reproduction device having speakers.

In the case of this example, a synthesized signal of sine wave signals with mutually different frequencies is used, as shown in the drawing. Specifically, this is a synthesized signal of sine wave signals is 50 Hz, 100 Hz, 200 Hz, 500 Hz, and 1 kHz.

Under such an analysis environment, the user 500 instructs the headphone 1 to start calibration operations. The calibration operation start instruction is performed by operating the instruction button provided to the operating unit 9 described earlier 9.

At the headphone 1, the calibration operation is realized by the function operations as the optimal filter property selecting/setting unit 5*d* and filter property analyzing unit 5*e*.

The filter property analyzing unit 5*e* performs analysis of frequency properties of the sound-collected data input via the A/D converter 3.

Figure 8A:
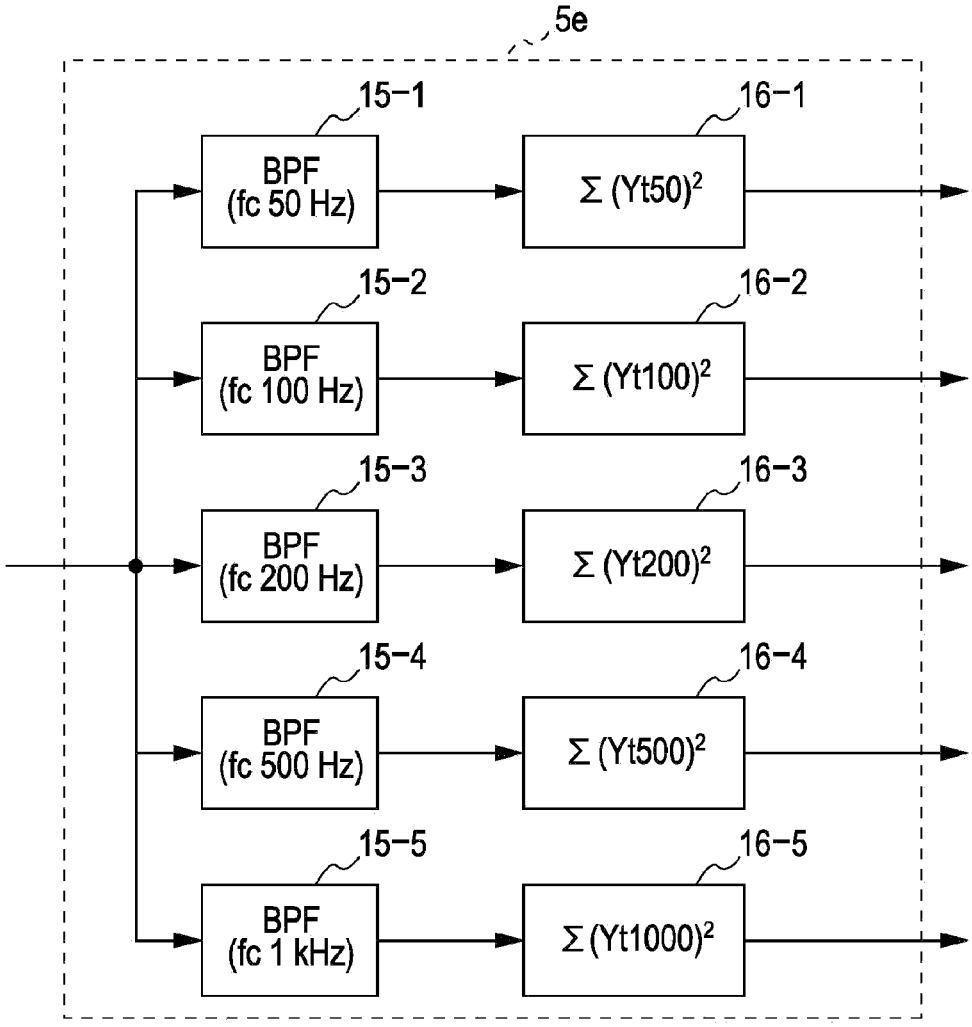
FIGS. 8A and 8B are diagrams illustrating a configuration example of a frequency property analyzing unit.
Figure 8B:
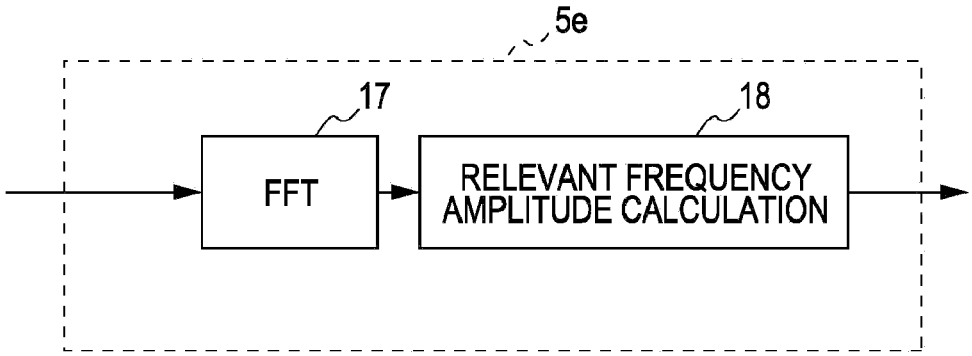

The filter property analyzing unit 5*e* may have a configuration such as shown in FIG. 8A or 8B, for example.

The configuration shown in FIG. 8A has multiple BPFs 15 in parallel, each set to a different cutoff frequency (center frequency) fc, and the energy (amplitude component) for each predetermined frequency point in the sound-collected data being obtained by calculating the squared cumulative sum of time-axis signals within a set period of the output of each BPF 15. Specifically, as for the BPFs 15 in this case, a total of five are provided in accordance with the sine wave frequencies included in the earlier test signal, which are a BPF 15-1 according to fc=50 Hz, a BPF 15-2 according to fc=100 Hz, a BPF 15-3 according to fc=200 Hz, a BPF 15-4 according to fc=500 Hz, and a BPF 15-5 according to fc=1 kHz. Also, squared cumulative sum computing units 16 for calculating the squared cumulative sum of time-axis signals within a set period of the output of each BPF 15 are provided in a one-on-one manner with each of these BPFs 15 (squared cumulative sum computing units 16-1 through 16-5).

Also, the configuration shown in FIG. 8B is for obtaining the amplitude value of the relevant frequency using FFT (Fast Fourier Transform). In this case, the sound-collected data is subjected to Fourier Transform at an FFT processing unit 17, and the amplitude value is calculated for each predetermined frequency point at a relevant frequency amplitude calculation unit 18. The relevant frequency amplitude calculation unit 18 calculates the amplitude value for each frequency point of 50 Hz, 100 Hz, 200 Hz, 500 Hz, and 1 kHz.

Thus, the filter property analyzing unit 5*e* obtains the amplitude component for each frequency point with regard the sound-collected data.

Returning to FIG. 4, the optimal filter property selecting/setting unit 5*d* performs operations generally following the following flow.

1) Frequency property analysis results of signals with noise not reduced that are obtained in a state where the noise canceling operations of the NC filter 5*a* are stopped, are obtained.

2) Filter properties stored in the filter property information database 8*b* are set to the NC filter 5*a* and frequency property analysis results of signals with noise reduced that are obtained in a state where the noise canceling operations are executed, are obtained.

3) The difference between the frequency property analysis results of signals with noise not reduced and the frequency property analysis results of signals with noise reduced is obtained, thereby obtaining a noise reduction effect indicator regarding the candidate filter properties.

4) Optimal filter properties are selected based on the noise reduction effect indicator.

5) The filter property No. of the selected optimal filter is stored, and the optimal filter is set to the NC filter 5*a*.

The functional operations of the optimal filter property selecting/setting unit 5*d* are described with reference to the following FIGS. 9A and 9B.

Figure 9A:
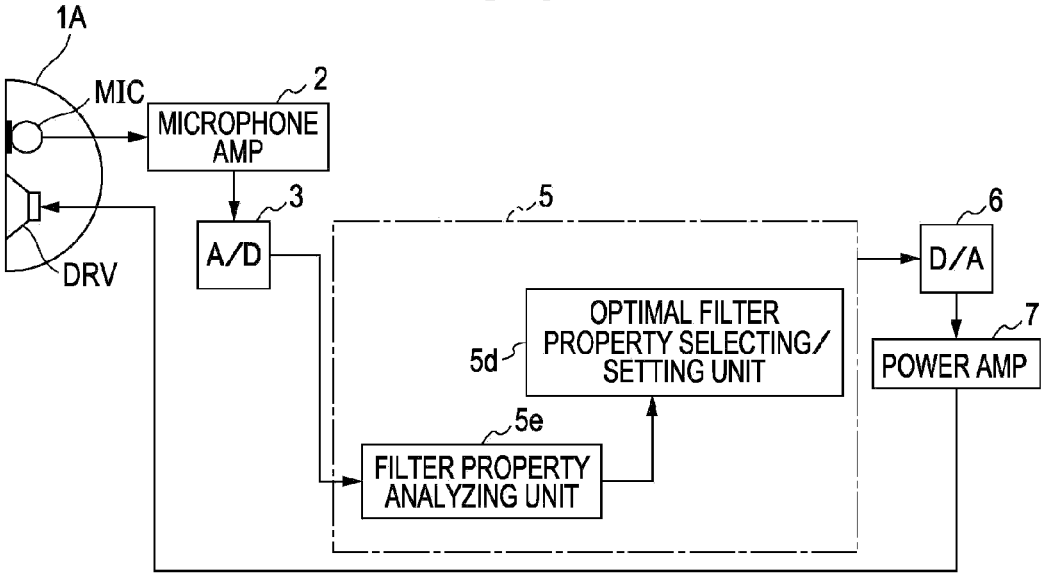
FIGS. 9A and 9B are diagrams for describing operations performed in accordance with signals with noise not reduced/signals with noise reduced in a case of employing the FB method.

First, FIG. 9A illustrates, in block form, the functional operations performed at the DSP 5 in accordance with analyzing of signals with noise not reduced. Note that in FIG. 9A (and FIG. 9B), the housing unit 1A, microphone MIC, driver DRV, microphone amp 2, A/D converter 3, D/A converter 6, and power amp 7, are shown along with the functional block of the DSP 5. In FIG. 9A, the optimal filter property selecting/setting unit 5*d* first stops the noise canceling operations performed by the NC filter 5*a* and the adding operations performed by the adding unit 5*c* (including equalizing operations by the equalizer 5*b*), in response to the above-described start instruction of calibration operations, whereby frequency property analysis can be performed by the filter property analyzing unit 5*e* regarding signals with noise not reduced.

Now, stopping the noise canceling operations performed by the NC filter 5*a* and the adding operations performed by the adding unit 5*c* turns the feedback loop off, and also addition of listening audio to the feedback loop is not performed. As a result, the sound-collected data obtained via the A/D converter 3 is only the in-house noise component within the housing unit 1A. That is to say, signals with noise not reduced can be obtained.

The optimal filter property selecting/setting unit 5*d* obtains the information of frequency properties of signals with noise not reduced (amplitude values for each frequency point) analyzed at the filter property analyzing unit 5*e* and obtained via the A/D converter 3, at the time of stopping the noise canceling operations performed by the NC filter 5*a* and the adding operations performed by the adding unit 5*c*.

The amplitude values for each frequency point regarding the signals with noise not reduced obtained here in this way will be written as Doff50, Doff100, Doff200, Doff500, and Doff1k, respectively.

Next, following calculating of the total value Doff regarding the signals with noise not reduced, the frequency property analysis results of signals with noise reduced obtained at the time of the filter properties stored in the filter property information database 8*b* being set in the NC filter 5*a* as candidate filter properties, and noise canceling being executed, are obtained. Specifically, in the case of the present example, the frequency property analysis results of signals with noise reduced obtained at the time of all of the filter properties stored in the filter property information database 8*b* being set in the NC filter 5*a* as candidate filter properties, are obtained.

Figure 9B:
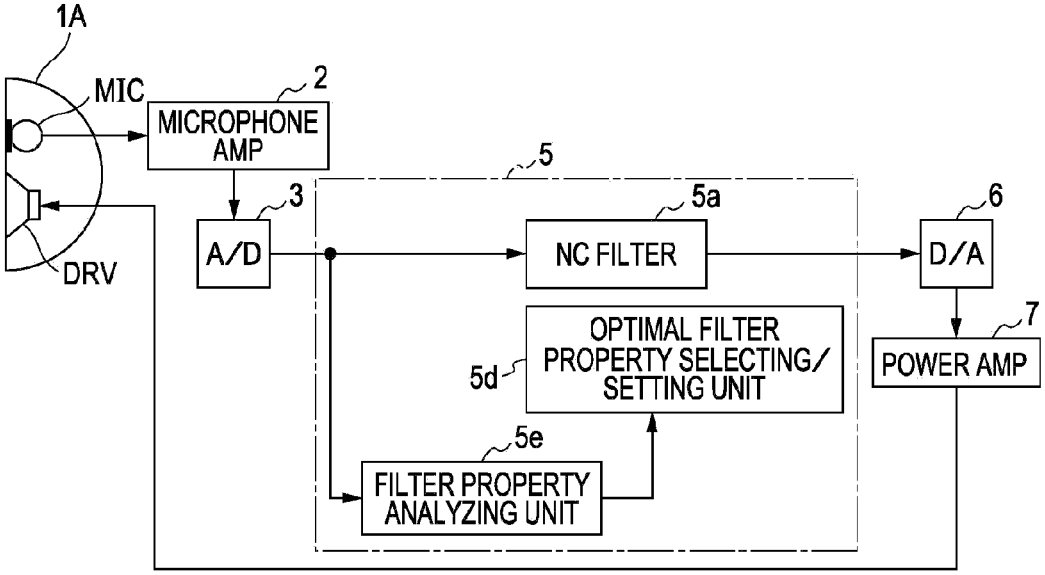

FIG. 9B is a block illustration of the functional operations of the DSP 5 executed in accordance with such analysis of signals with noise reduced. In this case, the candidate filter properties are set and noise canceling operations are being performed, so the feedback loop is in the on state.

Note however, while the noise canceling operations are on here, the adding operations performed by the adding unit 5*c* (including equalizing operations by the equalizer 5*b*) of listening audio signals remain off. This is in order to obtain proper analysis results regarding signals with noise reduced. That is to say, in the event that addition of listening audio signals is performed in a state with the feedback loop on, the component of the listening audio signals will be included in the sound-collected signals input to the DSP 54 via the A/D converter 3 as a matter of course, so component of the listening audio signals may prevent proper analysis of signals with noise reduced from being performed at the filter property analyzing unit 5*e*. Accordingly, with the present example, frequency property analysis of signals with noise reduced is performed with adding operations by the adding unit 5*c* remaining off. Accordingly, proper analysis results can be obtained regarding the signals with noise reduced.

Also, the difference between the frequency property analysis results of signals with noise not reduced and the frequency property analysis results of signals with noise reduced is obtained at the optimal filter property selecting/setting unit 5*d*, whereby a noise reduction effect indicator regarding each of the candidate filter properties can be obtained.

Now, with the present example, calculation of noise reduction effect indicator is performed each time one of the candidate filter properties is set and frequency properties of signals with noise reduced are obtained.

That is to say, with the filter property No. given to each set of filter property information stored in the filter property information database 8*b* as [m], the optimal filter property selecting/setting unit 5*d* sets the filter property No. [m] property to the NC filter 5*a* to execute noise canceling operations, and the frequency property analysis results regarding the sound-collected data from the A/D converter 3 analyzed by the filter property analyzing unit 5*e* at this time are obtained as the frequency property analysis results for the signals with noise reduced in the state that the filter property No. [m] has been set (the frequency property analysis results for the signals with noise reduced in the state that the filter property No. [m] has been set, that are obtained in this way, will be written as Don[m]50, Don[m]100, Don[m]200, Don[m]500, and Don[m]1k, respectively). Upon obtaining Don[m]50, Don[m]100, Don[m]200, Don[m]500, and Don[m]1k, in this way, the difference between the analysis results regarding signals with noise not reduced (Doff50, Doff100, Doff200, Doff500, and Doff1k) obtained earlier, and these Don[m]50, Don[m]100, Don[m]200, Don[m]500, and Don[m]1k are calculated. Specifically, Doff 50−Don[m]50,
Doff 100−Don[m]100,
Doff 200−Don[m]200,
Doff 500−Don[m]500, and
Doff 1k−Don[m]1k, are each calculated. The value of "Doff−Don[m]" is calculated for each of the frequency points, and the total value (where the total value is [m]) is saved as the noise reduction effect indicator for the No.[m] filter property.

Such series of operations of "setting No.[m] filter properties→obtaining frequency property analysis results for signals with noise reduced→calculating total value [m]" is sequentially performed for each of the filter properties stored in the filter property information database 8*b*. Thus, a noise reduction effect indicator is obtained for all candidate filter properties.

An example of the results of calculation of "Doff−Don[m]" for each frequency point is shown in FIG. 1A. Here, the signals with noise not reduced, obtained in the state that the noise canceling operations (and adding operation by the adding unit 5*c*) are off, include only the audio component based on the test signals. On the other hand, for signals with noise reduced, obtained with candidate filter properties set and the noise canceling operations in an on state, audio components based on the test signals are reduced somewhat.

Figure 10A:
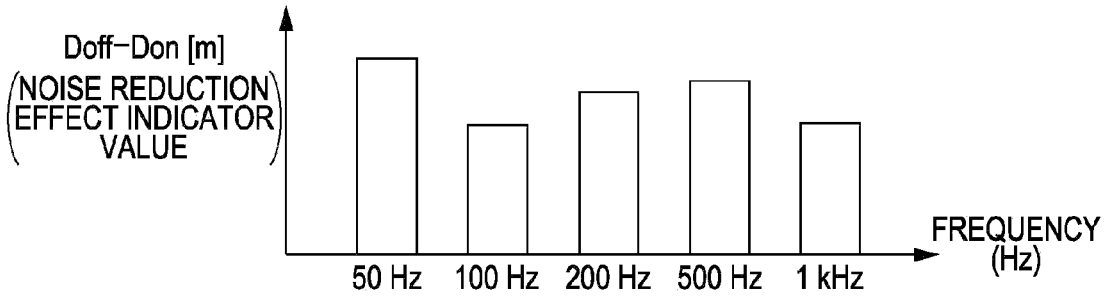
FIGS. 10A through 10C are diagrams for describing noise reduction effect indicators.

As can be understood from this as well, the difference between signals with noise not reduced and signals with noise reduced, expressed as "Doff−Don[m]", can be used as an indicator for evaluating noise reduction effects. The value of "Doff−Don[m]" for each frequency point shown in FIG. 10A can be used individually as an noise reduction effect indicator, but in the case of the present example, the total value [m] of these is used as the noise reduction effect indicator regarding the filter properties of the filter property No.[m].

Figure 10B:
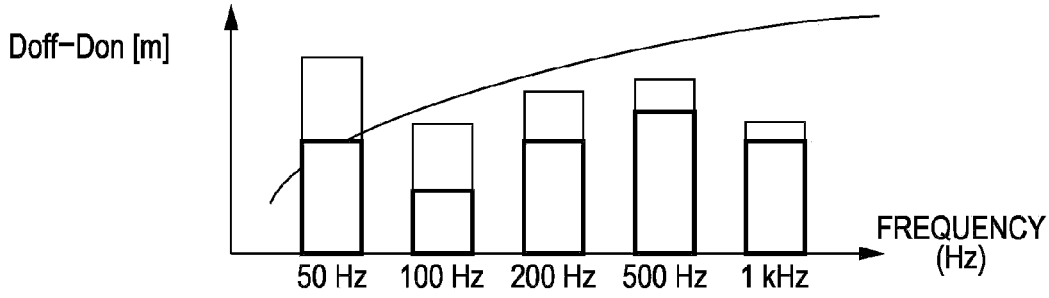

Note that in actual practice, obtaining of the total value [m] can be performed by weighting the values for "Doff−Don[m]" for each frequency point in accordance with an auditory perception property curve, as shown in FIG. 10B, and totaling these.

Figure 10C:
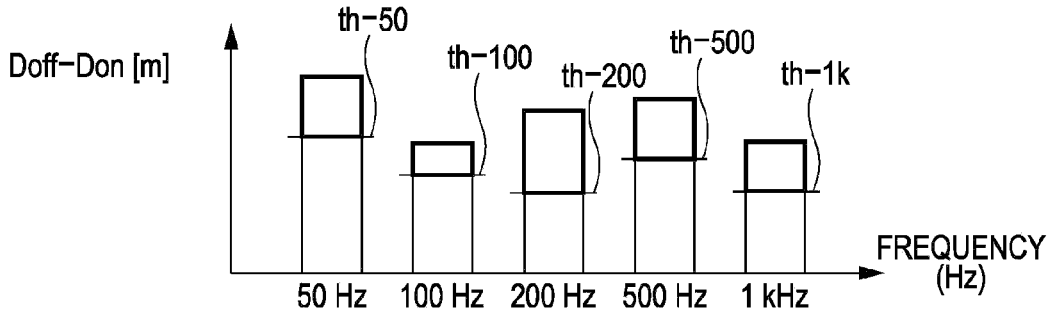

Also, for an example of a technique in the event of taking auditory perception properties into consideration, as shown in FIG. 10C, a threshold value th-50, threshold value th-100, threshold value th-200, threshold value th-500, and threshold value th-1k, may be set for each frequency point based on the auditory perception property curve, with only the portion of the values of "Doff−Don[m]" being included in calculation of the total value [m]. As for specific calculations, "Doff50−Don[m]50"−"th-50"
"Doff100−Don[m]100"−"th-100"
"Doff200−Don[m]200"−"th-200"
"Doff500−Don[m]500"−"th-500"
"Doff1k−Don[m]1k"−"th-1k"

are each calculated, and the total thereof is used as the total value [m].

Upon calculating the total value [m] regarding each of the candidate filter properties as described above, the filter properties to be set to the NC filter 5*a* are selected based on the total value [m]. Specifically, in this case, the candidate filter property which has the greatest total value [m] is selected as the optimal filter property, since it is the candidate filter property with the highest noise reduction effects. The filter property No. information of the selected optimal filter property is held (stored) in the memory 8.

Now, the selection operations of the optimal filter properties described so far is performed based on the analysis results regarding the test signal described earlier with FIG. 5, so in a state wherein the test signal is not properly sound-collected, proper selection of the optimal filter properties is not performed, of course.

Taking such a point into consideration for example, with the present example, in the event that the value of "Doff−Don[m]" for each frequency point calculated as described above does not satisfy a preset stipulated value, the operations for selecting optimal filter properties (calibration operations) are cancelled. Specifically, in the event that even one value of "Doff−Don[m]" for each frequency point does not satisfy the stipulated value, the operations for selecting optimal filter properties are cancelled.

Now, cases that can be conceived wherein the difference between Doff and Don[m] is not be sufficiently obtained, include no test signal being output at all or output being very small (insufficient S/N ratio as to ambient background noise), or trouble at the headphone 1 side, or the like. Accordingly, in the event that operations are canceled for selecting optimal filter properties, a notification is also made to notify the user 500 to the effect that these problems may be occurring and proper selection operations are not being performed. Specifically, message data (audio data) stored in the memory 8 beforehand for example, is output to the D/A converter 6, thereby making notification to the user by audio.

Note that in cases where a display unit such as a liquid crystal display or organic EL display or the like is separately provided, the notification can be visually performed by way of the display unit.

Thus, stopping operations for selecting optimal filter properties in the event that the value of "Doff−Don[m]" does not satisfy the stipulated value enables improper filter properties to be prevented from being selected and held as optimal filter properties. Also, the above notification enables the user 500 to be briefed on the status, thereby preventing confusion of the user 500.

Also, after selecting and storing the optimal filter properties, the optimal filter property selecting/setting unit 5*d* also performs operations for executing noise canceling operations in a state with the optimal filter properties set.

Figure 11:
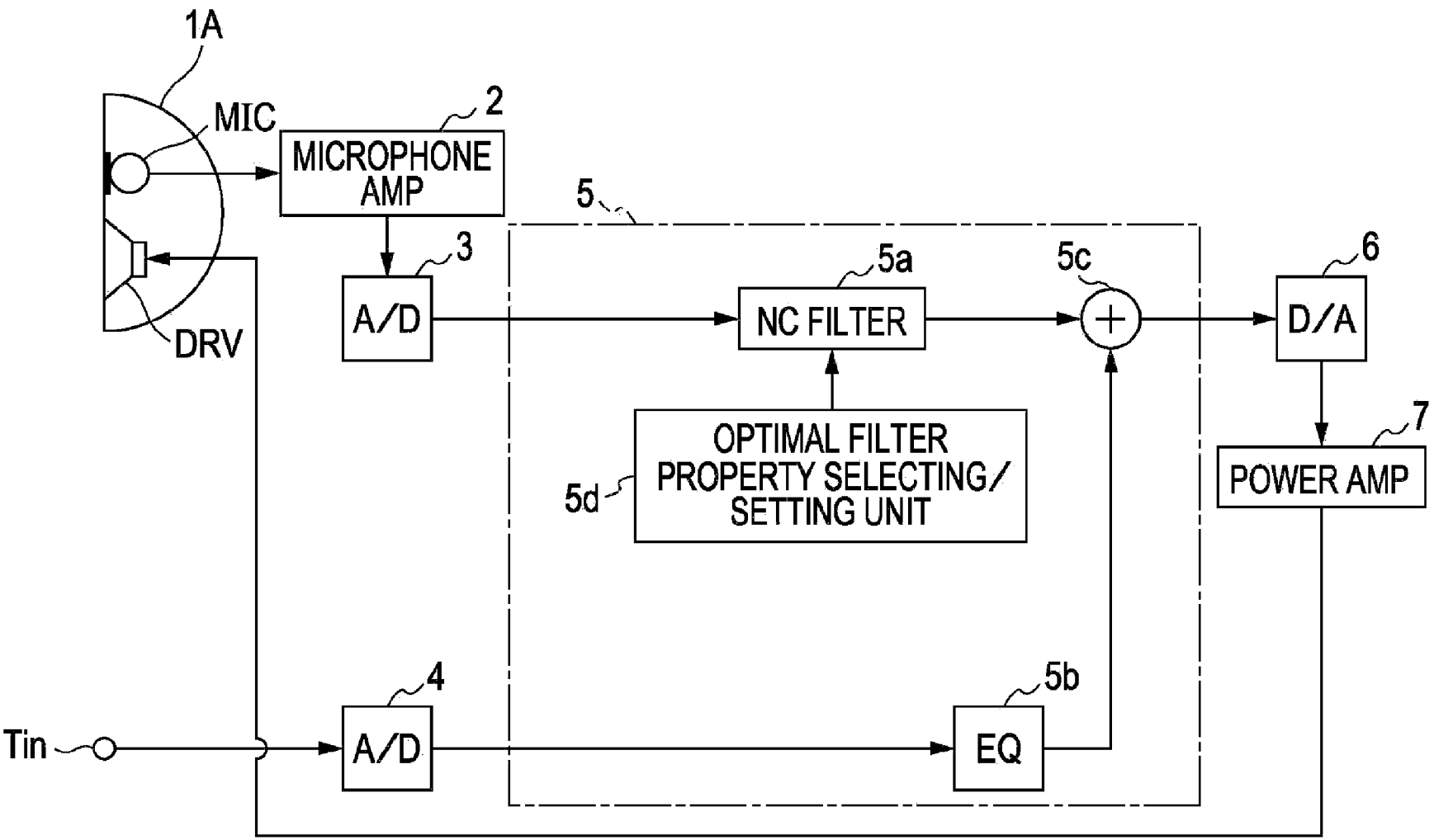
FIG. 11 is a diagram for describing operations performed in accordance at the time of optimal filter property setting/normal noise canceling operations in the case where the FB method is employed.

FIG. 11 illustrates, in blocks, function operations performed at the DSP 5 in accordance with such optimal filter property setting and normal noise canceling operations. Note that in FIG. 11 as well, the housing unit 1A, microphone MIC, driver DRV, microphone amp 2, A/D converter 3, D/A converter 6, and power amp 7, are shown along with the functional block of the DSP 5.

First, the optimal filter property selecting/setting unit 5*d* reads out the filter property No. information of the optimal filter properties stored in the memory 8, and sets the filter properties of the NC filter 5*a* to optimal filter properties based on the filter properties identified by the filter property No. read out from the optimal filter properties stored in the filter property information database 8*b*. In this state of the filter property information database 8*b* set, noise canceling operations with the NC filter 5*a*, equalizing operations regarding the listening audio signals, and adding operations with the adding unit 5*c*, are executed. That is to say, normal noise canceling operations including acoustic reproduction of listening audio signals are performed thereby.

Note that transition to such normal noise canceling can be conceived to be automatically performed upon completion of selection/storage of optimal filter properties. Alternatively, this may be performed in accordance to operation input by the user 500.

According to the present embodiment as described above, optimal filter properties are selected based on noise reduction effect indicators actually measured in a state of the user 500 actually wearing the headphone 1, so filter properties which are optimal in accordance with the acoustic part properties for each individual headphone 1, and the shape of the ears of the user 500 and the way in which the headphone 1 is worn, can be selected. That is to say, suitable filter properties can be selected which can absorb irregularities in the way in which the headphone 1 is worn.

According to this, adjustment by manual labor for property compensation before shipping, as with the related art, does not have to be performed, leading to reduction in labor costs and consequently reduction in device manufacturing costs. Also, this is not adjustment by manual labor using potentiometers and so forth, so even finer adjustment can be performed.

Also, the individual user does not have to perform the work of manual adjustment, thereby realizing an excellent noise canceling system where a load is not placed on the user in this point.

Also, with the present embodiment, the NC filter performing filtering processing for providing signal properties for noise canceling is configured of a digital filter, whereby the hardware configuration for realizing the calibration operations is simplified.

For example, in a case of using an analog circuit for the NC filter, in order to realize calibration operations, multiple filter circuits each having different filter properties have to be provided in parallel with each circuit being sequentially selected to perform analysis of signals with noise reduced, with regard to each candidate filter property, but such a configuration results in a large circuit scale, and is an unrealistic configuration.

On the other hand, with the case of the present example using a digital filter for the NC filter, switching of candidate filter properties can be performed by changing filter configurations and parameters, and can be handled by changing the program of the DSP 5 alone. In this point, the hardware configuration can be markedly simplified in comparison with a case where the NC filter is formed of an analog filter.

Figure 12:
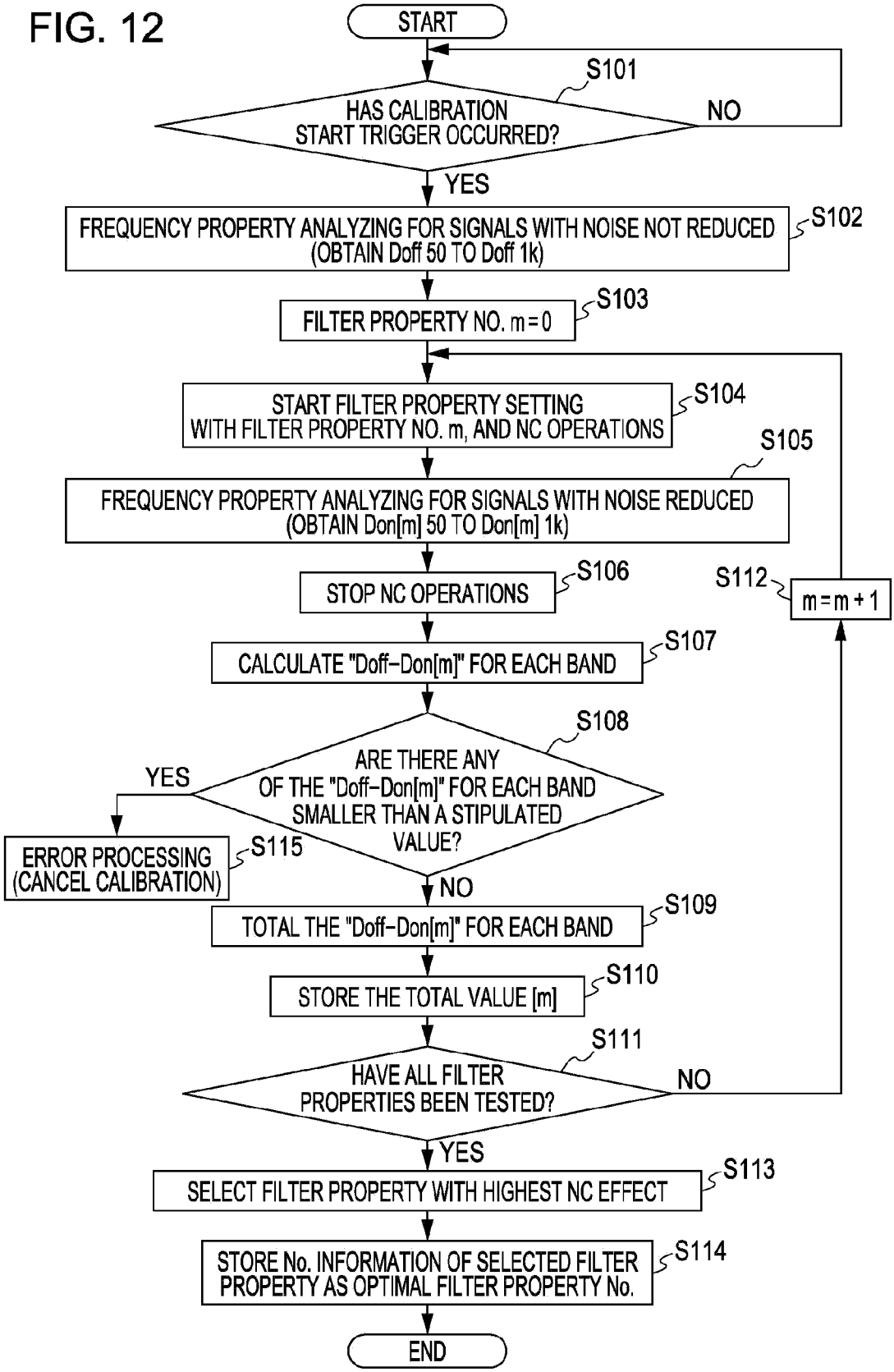
FIG. 12 is a flowchart illustrating processing procedures for realizing calibration operations as an embodiment.
Figure 13:
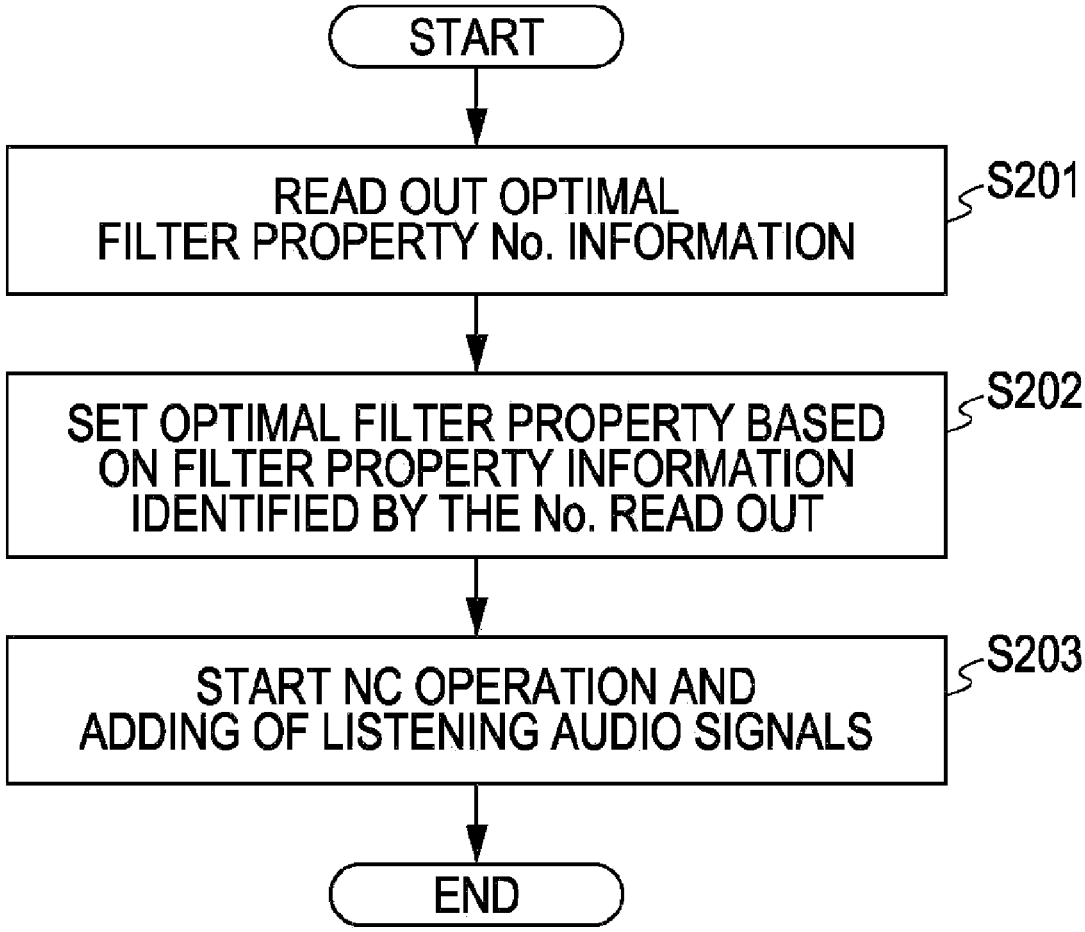
FIG. 13 is a flowchart illustrating processing procedures for realizing transition operations to normal noise canceling operations.

The flowcharts in FIGS. 12 and 13 illustrate processing procedures for realizing operations of the embodiment described above. FIG. 12 illustrates processing procedures for realizing calibration operations, and FIG. 13 for transition operations to normal noise canceling operations.

Note that in FIGS. 12 and 13, the processing procedures for realizing the operations of the present embodiment are illustrated as processing procedures to be executed by the DSP 5 based on the signal processing program 8*a*.

First, in FIG. 12, in step S101 the flow stands by for a calibration start trigger to occur. As can be understood from the description so far, the calibration operations in the case of the present embodiment start in accordance with the microcomputer 10 giving a command to the DSP 5, based on operation input by the user 500. Accordingly, the processing in step S101 is processing standing by for a start instruction from the microcomputer 10.

In the event that there is a start instruction from the microcomputer 10, and occurring of a start trigger for calibration operations has been configured, in step S102 frequency property analysis for signals with noise not reduced is performed. That is to say, the noise canceling processing by filtering processing of the NC filter 5*a*, and the adding operations of the adding unit 5*c* (including the equalizing operations of the equalizer 5*b*) are stopped, and in this state frequency property analysis is performed regarding sound-collected data (signals with noise not reduced) supplied form the A/D converter 3 by operations of the filter property analyzing unit 5*e*. As described above, with the filter property analysis, the amplitude value is obtained for each frequency point of 50 Hz, 100 Hz, 200 Hz, 500 Hz, and 1 kHz. Accordingly, with the processing in this step S102, the amplitude values Doff50, Doff100, Doff200, Doff500, and Doff1k, for each frequency point regarding the signals with noise not reduced, are obtained.

In the following step S103, processing is performed for setting the filter property No.[m] =0.

In the next step S104, processing is performed for setting filter properties with the filter property No.[m] and starting NC operations. That is to say, based on the filter property information to which the filter property No.[m] has been appended, the filter properties of the NC filter 5*a* are set to the filter properties identified by filter property No.[m], and in this state, the noise canceling operations are started.

Note that as described above, only the noise canceling operations are started here, and adding operations of the adding unit 5*c* remain off.

In the following step S105, frequency property analysis regarding signals with noise reduced is performed. That is to say, frequency property analysis is performed regarding the sound-collected data from the A/D converter 3 by the operations of the filter property analyzing unit 5*e*. Accordingly, Don[m]50, Don[m]100, Don[m]200, Don[m]500, and Don [m]1k, are obtained as frequency property analysis results in the state that the filter properties of the filter property No.[m] are set.

Then, after stopping NC operations in the following step S105, in step S106 the "Doff−Don[m]" is calculated for each band (frequency point). Specifically, Doff 50−Don[m]50,
Doff 100−Don[m]100,
Doff 200−Don[m]200,
Doff 500−Don[m]500, and
Doff 1k−Don[m]1k, are each calculated.

In the following step S108, determination is made regarding whether or not there is any "Doff–Don[m]" for each band where the stipulated value is not satisfied.

In the event that a positive result is obtained that there is a "Doff–Don[m]" of each band where the stipulated value is not satisfied, the flow advances to step S115 and error processing is executed. In this error processing, notification is made to the user 500 to the effect that no test signal is being output at all or output is very small, or there is trouble at the device side, or the like, and that there is a possibility that proper selection operations are not performed, as with the above exemplary illustration.

By providing the determination processing in step S108 and the error processing in step S115, operations for selecting optimal filter properties can be cancelled in the event that there is a "Doff–Don[m]" of a band where the stipulated value is not satisfied.

On the other hand, in the event that a negative result is obtained in step S108 that there is no "Doff–Don[m]" of each band where the stipulated value is not satisfied, the flow advances to step S109 and the values of the "Doff–Don[m]" of each band are totaled (calculating total value [m]).

Note that as described earlier, an arrangement may be made wherein not only are the "Doff–Don[m]" for each frequency point simply totaled for the total value [m], but a total may be obtained by weighting the values for "Doff–Don[m]" for each frequency point in accordance with an auditory perception property curve, or a total of only portions exceeding threshold values th.

In the following step S110, the total value [m] is stored in the memory 8 as storage processing of the total value [m].

In step S111, determination is made regarding whether all filter properties have been tried. That is to say, determination is made that, with the number of filter property information sets stored in the filter property information database 8*b* as n, whether or not m=n has been achieved.

In the event that a negative result is obtained in step S111 that m=n does not hold and not all filter properties have been tried, the flow proceeds to step S112 and the value of m is incremented (m=m+1), following which the flow returns to the earlier described step S104.

Thus, the noise reduction effect indicators for all filter properties stored in the filter property information database 8*b* (in this case, the total value [m]) are calculated and stored.

Also, in the event that a positive result is obtained in step S111 that m=n does holds and all filter properties have been tried, the flow proceeds to step S113 and processing is performed for selecting the filter property with the highest NC effect (noise reduction effect). That is to say, the filter property (filter property No. information) with the greatest value for the total value [m] is selected.

Thereupon, in the following step S114, processing is performed for storing the filter property No. information as the optimal filter property No. information. That is to say, the filter property No. information selected by the processing in step S113 is stored in the memory 8.

Upon executing the storage processing in step S114, the series of processing shown in this drawing end.

Next, the procedures for processing to be executed corresponding to the time of transition to normal noise canceling operations will be described with reference to FIG. 13.

As can be understood from the earlier description, the processing shown in FIG. 13 is automatically started in accordance with the calibration operations shown in FIG. 12 for example ending. Alternatively, this may be performed in accordance to operation input by the user 500.

In FIG. 13, first in step S201, the optimal filter property No. information is read out. In the following step S202, processing for setting the optimal filter property is performed based on the filter property information identified by the No. read out. That is to say, the filter configuration/parameters are set for the NC filter 5*a* based on the filter property information identified by the filter property No. information read out above.

In the following step S203, NC operations and adding operations of listening audio signals are started. That is to say, noise canceling operations are started in the state that the optimal filter properties have been set, and also adding operations of the adding unit 5*c* (including the equalizing operations of the equalizer 5*b*).

Upon executing the processing in this step S203, the series of processing shown in this drawing end. Second Embodiment (Example of Application to FF Method) Next, an example of application to the FF method will be described as a second embodiment.

Figure 14:
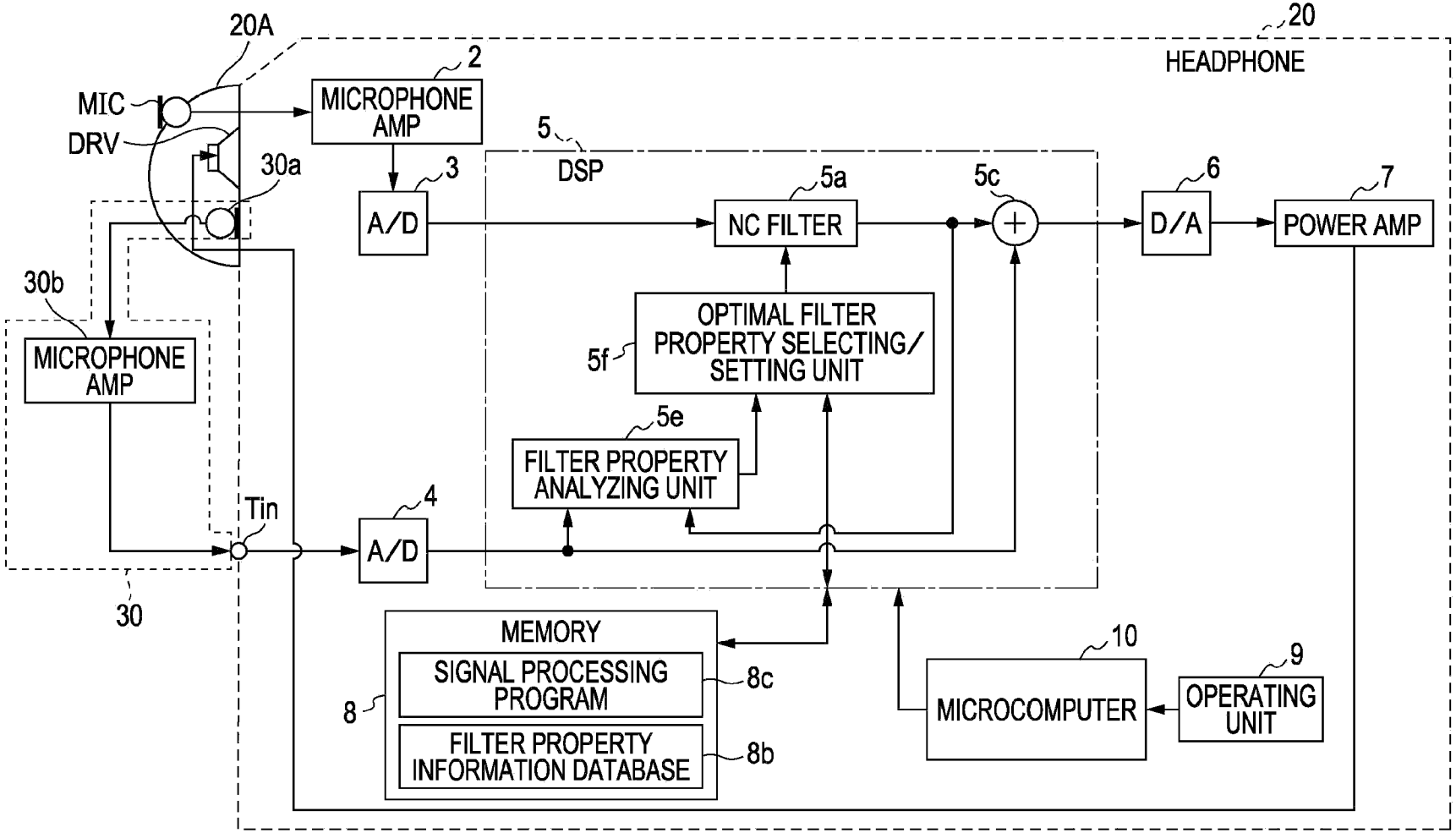
FIG. 14 is a block diagram illustrating the internal configuration of a signal processing device serving as a second embodiment.

FIG. 14 is a block diagram illustrating the internal configuration of a headphone 20 serving as a second embodiment, realizing calibration operations (and transition operations to normal noise canceling operations) as an embodiment in a case of employing the FF method.

In FIG. 14, a housing unit 20A provided to the headphone 20, and the internal configuration of an analysis object sound-collecting unit 30 to be described later, are shown together.

Also, in the following description, portions which are the same as portions already described will be denoted with the same reference numerals and description thereof will be omitted.

The headphone 20 shown in FIG. 14 differs in comparison with the headphone 1 shown in FIG. 4 earlier in that the formation position of the microphone MIC is different. Specifically, with the case of the FF method, the microphone MIC is position on the outer side of the housing unit 20A, so as to sound-collect sound generated at the world outside the housing unit 20A, as can be understood from the earlier description of FIG. 3A.

Now, in order to obtain suitable noise reduction effect indicators at the time of performing calibration operations, comparison of signals with noise not reduced and signals with noise reduced should be performed based on an audio listening point (noise cancellation point 400 in FIGS. 1A, 1B, 3A, and 3B) by the user 500.

In the case of the FB method illustrated earlier in FIG. 4, the microphone MIC is provided on the inner side of the housing unit 1A, so the amplitude component of the signals with noise not reduced, at the listening point based on sound-collected signals from the microphone MIC. However, in the case of the FF method, the microphone MIC for noise monitoring is provided to the outer side of the housing unit 20A as described above, so analysis of the amplitude component of the signals with noise not reduced are not performed using this microphone MIC.

Accordingly, in the case of employing the FF method, a separate microphone is disposed on the inner side of the housing unit 20A under the analyzing environment such as shown earlier in FIG. 5, and analysis of the amplitude component of the signals with noise not reduced is performed using sound-collected signals from this microphone.

Specifically, an analysis object sound-collecting unit 30 provided with a microphone 30*a* and a microphone amp 30*b* for amplifying the sound-collected signals from the microphone 30*a* is used. This analysis object sound-collecting unit 30 is provided with a terminal from which output signals from the microphone amp 30*b* are supplied, and by the user 500 connecting this terminal to the audio input terminal Tin provided to the headphone 20, the sound-collected signals obtained based on the sound-collecting operations of the microphone 30*a* can be input to the headphone 20, more particularly to the A/D converter 4.

With the headphone 20 shown in FIG. 14, here are changes also made to the functions of the DSP 5, in accordance with the points of change from such an FB method.

Specifically, a signal processing program 8*c* is stored in the memory 8 instead of the earlier signal processing program, and for the functions of the DSP 5, a function of an optimal filter property selecting/setting unit 5*f* is provided instead of the functions of the optimal filter property selecting/setting unit 5*d*.

Note that in the case of employing the FF method, the functions of the equalizer 5*b* may be omitted. Accordingly, with the DSP 5 in this case, the functions of the equalizer 5*b* are omitted as shown in the drawing, and the adding unit 5*c* performs addition of signals following filtering processing by the NC filter 5*a*, and listening audio signals to be input to the A/D converter 4.

The optimal filter property selecting/setting unit 5*f* differs from the optimal filter property selecting/setting unit 5*d* in the first embodiment in that at the time of analyzing signals with noise not reduced and signals with noise reduced, frequency property analysis of the sound- collected signals (sound-collected data) from the analysis object sound-collecting unit 30 to be input from the A/D converter 4 is executed by the filter property analyzing unit 5*e*.

Figure 15A:
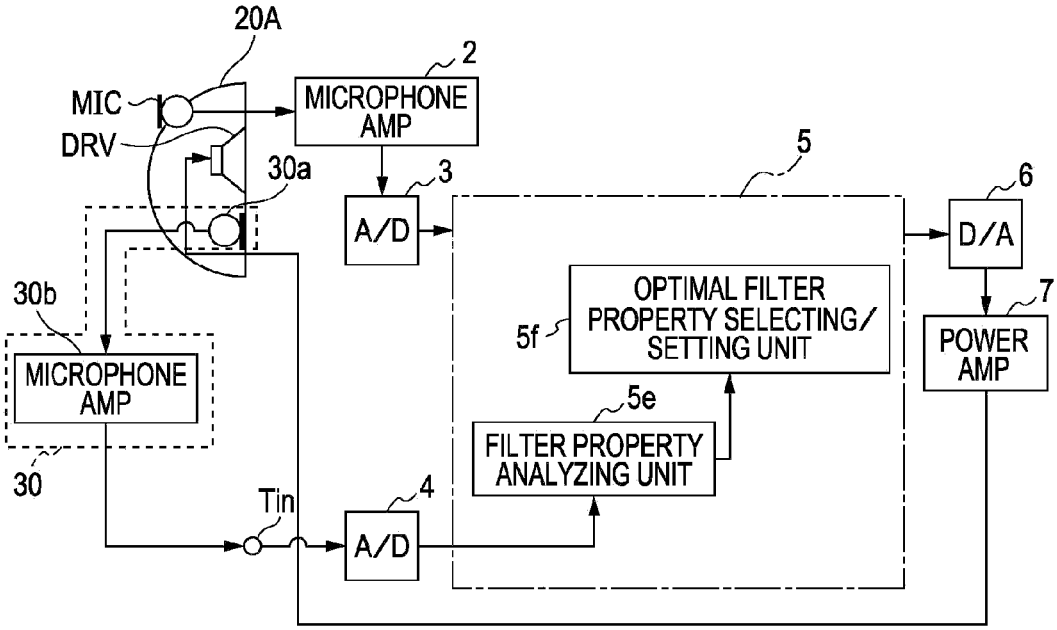
FIGS. 15A and 15B are diagrams for describing operations performed in accordance with signals with noise not reduced/signals with noise reduced in a case of employing the FF method.
Figure 15B:
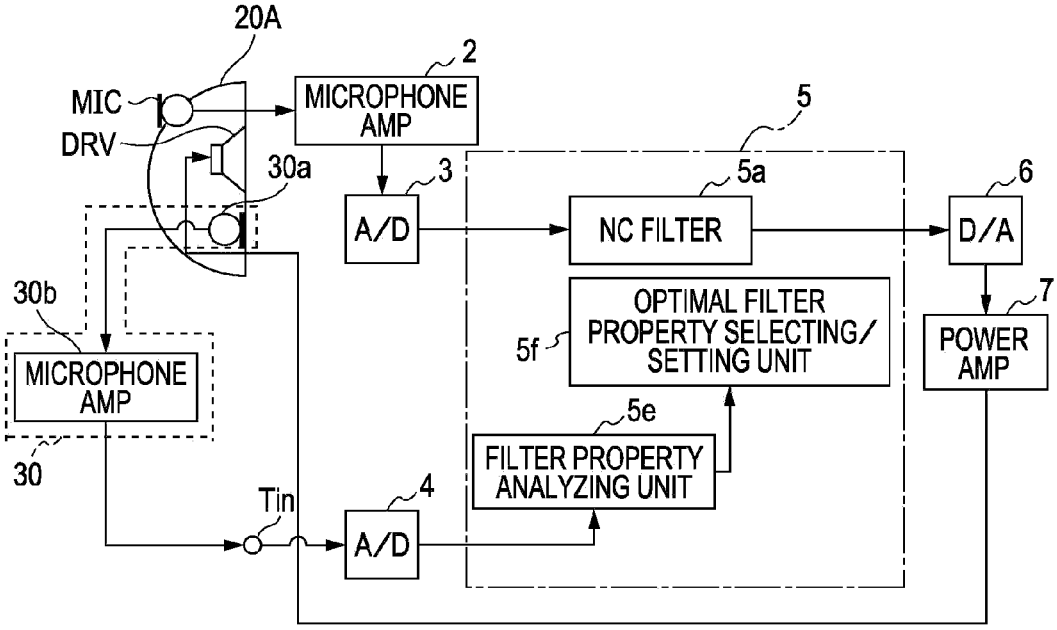

FIGS. 15A and 15B are diagrams illustrating in block form the function operations of the DSP 5 performed in accordance with the time of calibration operations in the case of the second embodiment, wherein FIG. 15A illustrates regarding analyzing of signals with noise not reduced, and FIG. 15B illustrates regarding analyzing of signals with noise reduced. Note that in FIGS. 15A and 15B, the housing unit 20A, microphone MIC, driver DRV, microphone amp 2, A/D converter 3, D/A converter 6, power amp 7, and analysis object sound-collecting unit 30, are shown along with the functional block of the DSP 5.

First, at the time of analyzing of signals with noise not reduced shown in FIG. 15A, the optimal filter property selecting/setting unit 5*f* stops the noise canceling operations performed by the NC filter 5*a* and the adding operations performed by the adding unit 5*c* in response to the start instruction of calibration operations supplied from the microcomputer 10 based on operation input by the user 500, whereby frequency property analysis is performed by the filter property analyzing unit 5*e* regarding sound-collected data from the analysis object sound-collecting unit 30 input via the A/D converter 4. Accordingly, frequency property analysis results regarding signals with noise not reduced (Doff50, Doff100, Doff200, Doff500, and Doff1k) are obtained.

Also, at the time of analyzing of signals with noise reduced shown in FIG. 15B, the optimal filter property selecting/setting unit 5*f* turns the noise canceling operations performed by the NC filter 5*a* on, and causes the filter property analyzing unit 5*e* to execute frequency property analysis. That is to say, this obtains frequency property analysis results regarding the signals with noise reduced that are obtained as a result of having performed noise canceling in space on the signals following the filter processing by the NC filter 5*a*, and the optimal filter property selecting/setting unit 5*f* obtains the frequency property analysis results Don[m]50, Don[m]100, Don[m]200, Don[m]500, and Don[m]1k, regarding signals with noise reduced.

Note that at the time of selecting optimal filter properties in this case as well, the point of sequentially setting each filter property in the NC filter 5*a* based on the stored information within the filter property information database 8*b* and obtaining the frequency property analysis results of signals with noise reduced, is the same as with the case of the first embodiment.

Figure 16:
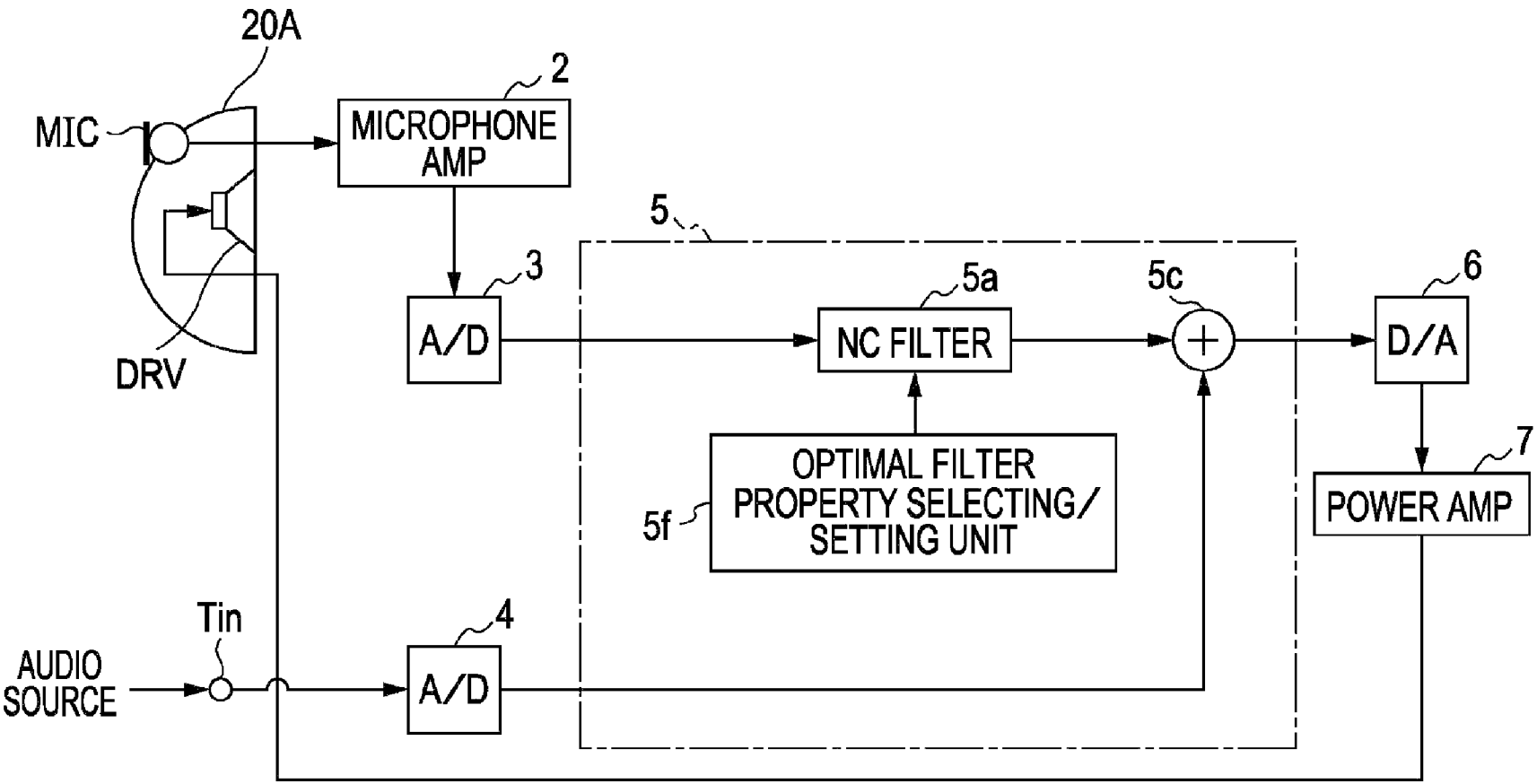
FIG. 16 is a diagram for describing operations performed in accordance at the time of optimal filter property setting/normal noise canceling operations in the case where the FF method is employed.

It should be noted that the function operations performed at the DSP 5 in accordance with optimal filter property setting and normal noise canceling operations are shown in FIG. 16. Note that in FIG. 16 as well, the housing unit 20A, microphone MIC, driver DRV, microphone amp 2, A/D converter 3, D/A converter 6, power amp 7, and analysis object sound-collecting unit 30, are shown along with the functional block of the DSP 5. In the case of the FF method shown in the drawing, following selecting and storing optimal filter properties, filtering processing by the NC filter 5*a* in the state with the optimal filter properties set is executed, and also and the adding operations performed by the adding unit 5*c* of the signals following filtering processing by the NC filter 5*a* and the input signals from the audio input terminal Tin is started. Thus, normal noise canceling operations are performed.

As can be understood from the description so far, at the time of normal noise canceling operations, the point that audio signals are input from an audio source to the audio input terminal Tin should be noted.

Specific processing procedures for realizing operations a the second embodiment such as described above can be the same as those illustrated in FIGS. 12 and 13 earlier.

Note however, that the frequency property analysis processing regarding signals with noise not reduced in step S102 in FIG. 12 is processing wherein frequency property analysis is performed regarding sound-collected data from the analysis object sound-collecting unit 30 input via the A/D converter 4 in a state with the noise canceling operations performed by the NC filter 5*a* and the adding operations performed by the adding unit 5*c* stopped, as can be understood from the earlier description.

Also, the frequency property analysis processing regarding signals with noise reduced in step S105 is processing wherein frequency property analysis is performed regarding sound-collected data from the analysis object sound-collecting unit 30 input via the A/D converter 4 in a state with the noise canceling operations performed by the NC filter 5*a* on (in this case as well, the adding operations of listening audio signals performed by the adding unit 5*c* remain off).

Now, as can be understood from the above description, in the case of employing the FF method, the analysis object sound-collecting unit 30 has to be provided separately, for performing analysis of signals with noise not reduced. However, as can be understood from viewing FIGS. 14 through 15B, the connection destination of the analysis object sound-collecting unit 30 can be the audio input terminal Tin provided beforehand to the headphone 20 as input for listening audio signals. Accordingly, further separate input terminals or A/D converters do not have to be provided, and the calibration operations can be realized just with a sound-collecting jig to serve as the analysis object sound-collecting unit 30, and changing of the program of the DSP 5.

Modifications

While description has been made regarding the embodiments of the present invention, the present invention is not restricted to the specific examples described so far.

For example, description has been made so far only regarding a case where calibration operations are made with the headphone 1 or 20 actually worn by the user, the calibration operations may be performed before factory shipping, on a manufacturing line or the like for example.

Figure 17:
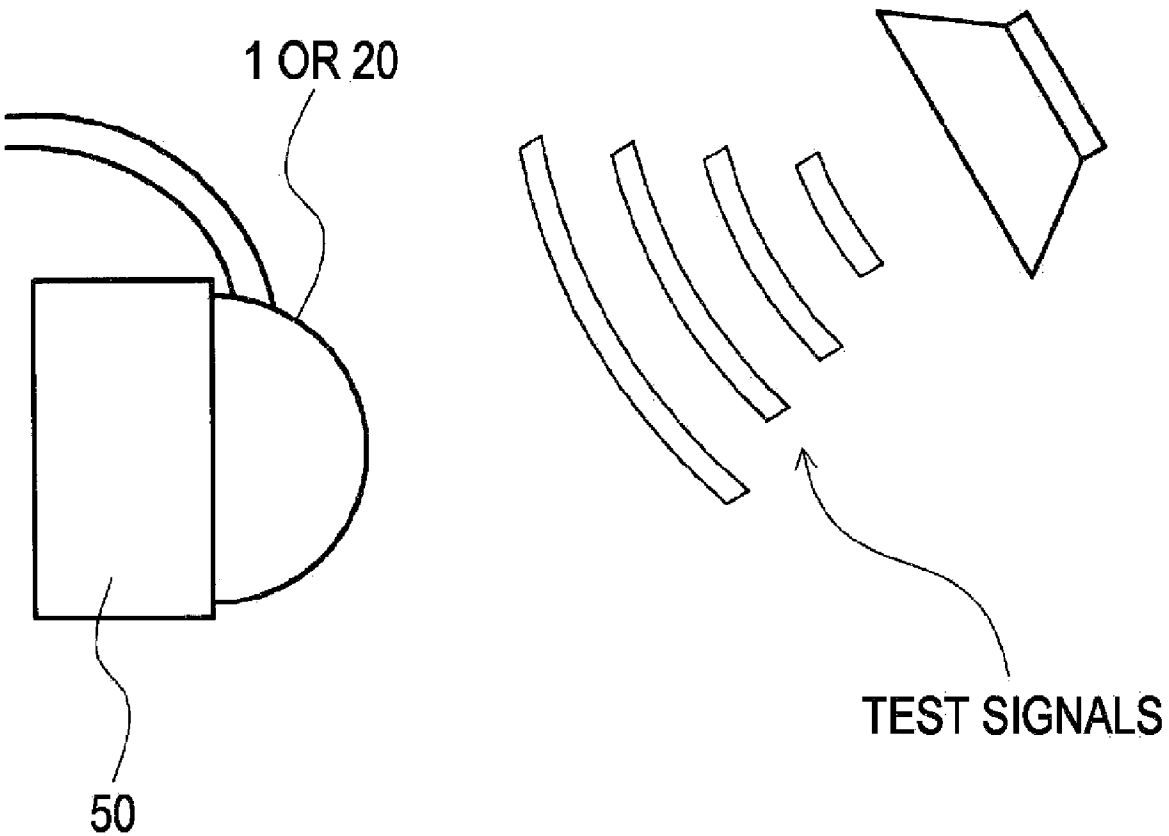
FIG. 17 is a diagram exemplarily illustrating an analyzing environment in a case of executing calibration operations before shipping.

In this case, the headphone 1 or 20 is mounted on an acoustic coupler as shown in FIG. 17 next for example, and output of test signals and calibration operations with the headphone 1 or 20 are performed. The acoustic coupler 50 is such created simulating the acoustic conditions in an actual ear (acoustic impedance, degree of isolation, etc.).

Performing such calibration operations before factory whipping enables property compensation regarding irregularities in acoustic parts which the headphone 1 or 20 has.

Note that the acoustic coupler 50 has to be set to certain representative conditions for the acoustic conditions of actual ears, property compensation may not be able to be performed corresponding to the shape of the ears of the user (and way of wearing), due to the calibration operations before factory shipping, but this is advantageous from the point that the user does not have to take the trouble to execute calibration for the headphone 1 or 20 under the analysis conditions shown in FIG. 5 following purchasing.

It should be noted that in the case of the first embodiment corresponding to the FB method, a microphone does not have to be provided within the acoustic coupler 50 in particular, but in the case of the second embodiment corresponding to the FF method, a microphone has to be provided within the acoustic coupler 50, and sound-collected signals from the microphone provided within the coupler 50 are input to the audio input terminal Tin via the microphone amp.

Also, description has been made so far in a simplified manner with the number of channels of audio signals (including sound-collected signals) being only single-channel, but the present invention can be suitably applied to cases wherein acoustic reproduction is performed regarding acoustic signals of multiple channels, as well.

Also, with the description so far, calculation of the noise reduction effect indicator (total value [m]) regarding each candidate filter property has been exemplarily illustrated with a case of sequentially performing calculation for the settings for each candidate filter property, but an arrangement may be made wherein, for example, frequency property analysis results of signals with noise reduced are obtained for all candidate filters, following which the noise reduction effect indicator for each candidate filter property is calculated.

Also, with the description so far, a case has been exemplarily illustrated wherein noise reduction effect indicators for all candidate filter properties are obtained and then the filter property with the greatest value is selected as the optimal filter property, but instead of this, an arrangement may be made wherein optimal filter property selection is performed in accordance with the total value [m] reaching a certain reference value or higher, thereby ending the calibration operation.

Figure 18:
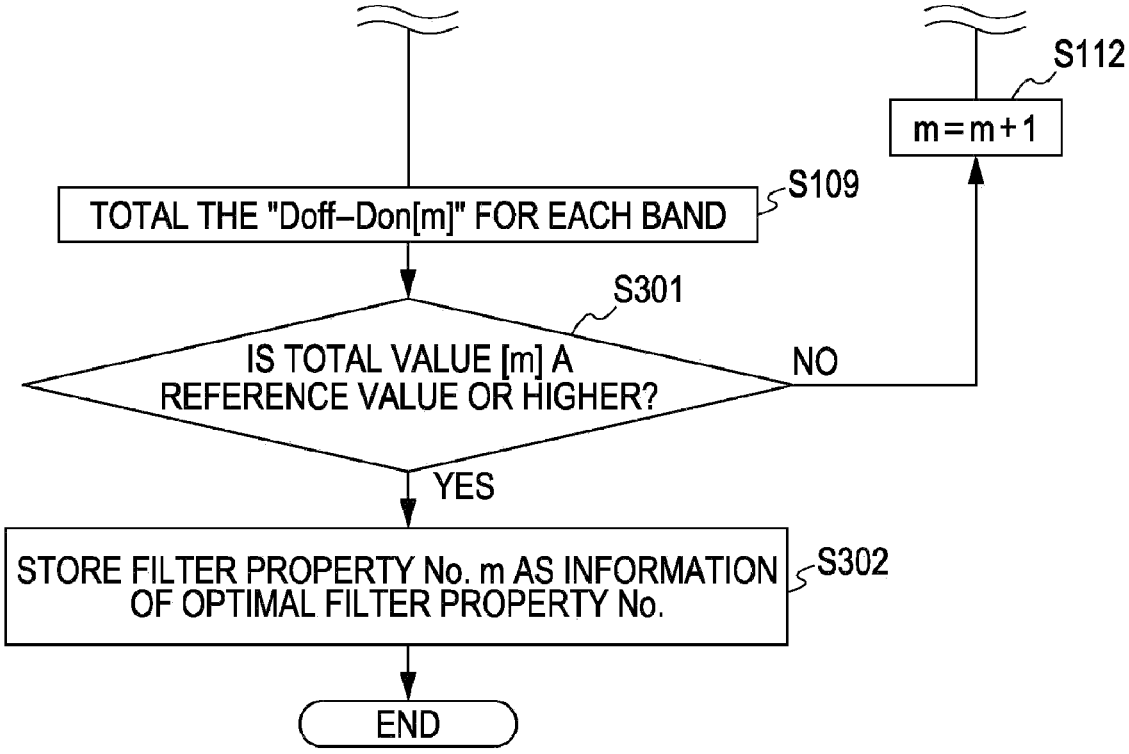
FIG. 18 is a diagram for describing a modification relating to a filter property selection technique.

FIG. 18 illustrates an example of the processing procedures in this case. Note that FIG. 18 primarily only shows the points changed from the earlier FIG. 12, and the other processing is the same as in FIG. 12 and accordingly has been omitted from the drawing to avoid redundancy.

With the case shown in the drawing, in step S109 the "Doff–Don[m]" for each band are totaled, following which in step S301, determination is made regarding whether or not the total [m] is a reference value or higher. In the event that a negative result is obtained in step S301 that the total [m] is not the reference value or higher, the flow proceeds to the incrementing processing in step S112 that is to say, accordingly, processing is executed for obtaining the total [m] for the filter property of the next filter property No. In step S301, in the event that a positive result is obtained that the total [m] is the reference value or higher, in step S302 processing is executed for storing the filter property No. m as optimal filter property No. information.

Note that in this case, the total [m] is only used in sequential determination, so the processing for storing the total [m] in step S110 shown in FIG. 12 can be omitted.

Thus, whether or not the total [m] is the reference value or higher is sequentially determined, and in the event that a filter property with the reference value or higher is obtained, an operation is performed for selecting that filter property as the optimal filter property, whereby the time taken for calibration operations can be shortened, and the burned of processing can be alleviated.

Also, description has been made so far that the total value of the difference value (Doff–Don[m]) is obtained for each frequency point, as the noise reduction effect indicator, but an arrangement may be mad wherein the difference values for each frequency point themselves are used as noise reduction effect indicators. In this case, an arrangement may be made for selection of the optimal filter property wherein a reference value is provided for each frequency point, and a filter property where a value of or higher than the reference value is obtained at all frequency points is selected as the optimal filter property.

Also, while description has been made in the earlier FIG. 10C that a threshold value th is set for the difference values at each frequency point, a technique may be employed wherein, if there is even one frequency point not satisfying the threshold value th, this is eliminated form the object of selection as the optimal filter property.

Using such a technique enables improved precision of calibration, in that the noire reduction effects are kept high.

Also, while description has been made so far that the optimal filter property No. information is stored, but the filter property information of the optimal filter property itself may be stored.

Also, while sine wave signals of multiple representative frequencies have been described as being used as the test signal, so that noise reduction effects with the candidate filter properties can be easily and speedily measured, wideband signals may be used within a range allowable by the processing capabilities of the DSP 5, for example.

Alternatively, under conditions where the ambient noise is steady, output of test signals does not have to be performed.

Also, while a so-called on-ear headphone device which is worn so that the housing units cover the ears of the user has been exemplarily illustrated, the present invention can also be suitably applied to headphone devices of all types other than the on-ear type. For example, embodiments of the present invention may be suitably applied to so-called inner-ear type (earphone) headphone devices, which are worn by a part of the headphone device being inserted into the ear canal of the user, and so forth.

Also, while description has been made so far regarding a case of the signal processing device according to the present invention being realized as a headphone device, but the signal processing device according to the present invention can be realized in other device forms as well, such as an audio player, cellular phone, headset, or the like, having noise canceling functions, for example.

The present application contains subject matter related to that disclosed in Japanese Priority Patent Application JP 2008-122508 filed in the Japan Patent Office on May 8, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing device comprising:

filter processing means configured to execute noise reduction operations by subjecting sound-collected signals from sound-collecting means to filtering processing based on preset filter properties and providing signal properties for noise reduction;

noise-unreduced signal obtaining means configured to obtain noise-unreduced signals obtained in a state where noise reduction operations by said filter processing means are stopped; and filter property selecting means configured to obtain a difference between said noise-unreduced signals and noise-reduced signals obtained at a time of executing the noise reduction operations with the preset filter properties set to said filter processing means as a candidate filter property, thereby obtaining a noise reduction effect indicator regarding said candidate filter property, and selecting filter properties to be set to said filter processing means based on said noise reduction effect indicator.

2. The signal processing device according to claim 1, further comprising:

storage means configured to store information of the filter properties selected by said filter property selecting means.

3. The signal processing device according to claim 2, further comprising:

setting means configured to set a filter property, corresponding to stored information in said storage means, to said filter processing means.

4. The signal processing device according to claim 3, wherein said filter property selecting means calculate a difference in amplitude component for each predetermined frequency point, as a difference between said noise-unreduced signals and said noise-reduced signals.

5. The signal processing device according to claim 4, wherein said filter property selecting means sequentially perform calculation of the difference in amplitude component for each predetermined frequency point between said noise-unreduced signals and said noise-reduced signals, each time said noise-reduced signals regarding one candidate filter property are obtained.

6. The signal processing device according to claim 5, wherein said filter property selecting means calculate a total value of the differences in amplitude component for each predetermined frequency point between said noise-unreduced signals and said noise-reduced signals, as said noise reduction effect indicator, and select a candidate filter property with a greatest total value as the filter property to be set to said filter processing means.

7. The signal processing device according to claim 5, wherein said filter property selecting means calculate a total value of the differences in amplitude component for each predetermined frequency point between said noise-unreduced signals and said noise-reduced signals, as said noise reduction effect indicator, and select a candidate filter property of which the total value satisfies conditions based on a predetermined stipulated value, as the filter property to be set to said filter processing means.

8. The signal processing device according to claim 5, wherein said filter property selecting means take a value of the difference in amplitude component for each predetermined frequency point, calculated regarding said noise-unreduced signals and said noise-reduced signals, as said noise reduction effect indicator, and select a candidate filter property of which the noise reduction effect indicator at each frequency point satisfies conditions based on predetermined stipulated values for each frequency point, as the filter property to be set to said filter processing means.

9. The signal processing device according to claim 5, wherein said filter property selecting means cancel filter property selection operations in the event that at least one value of the difference in amplitude component for each predetermined frequency point, calculated regarding said noise-unreduced signals and said noise-reduced signals, does not satisfy a predetermined value set beforehand.

10. The signal processing device according to claim 1, wherein said sound-collecting means are provided on an inner side of a housing unit worn on an ear of a listener;

and wherein said noise-unreduced signal obtaining means obtain sound-collected signals from said sound-collecting means, at a time of noise reduction operations by said filter processing being stopped, as said noise-unreduced signals.

11. The signal processing device according to claim 1, further comprising:

input means configured to input other sound-collected signals obtained from other sound-collected means, provided on an outer side of a housing unit worn on an ear of a listener, separate from said sound-collecting means provided on the inner side of said housing unit;

wherein said noise-unreduced signal obtaining means obtain input signals from said input means, at a time of noise reduction operations by said filter processing being stopped, as said noise-unreduced signals.

12. The signal processing device according to claim 11, further comprising:

adding means configured to add listening audio signals to the noise-reduced signals obtained by said filter processing means;

wherein said input means are used in common for input of said other sound-collected signals from said other sound-collecting means, and input of said listening audio signals.

13. A signal processing method comprising steps of:

obtaining noise-unreduced signals in a state where noise reduction operations by filter processing means, which execute the noise reduction operations by subjecting sound-collected signals from sound-collecting means to filtering processing based on preset filter properties and providing signal properties for noise reduction, are stopped; and obtaining a difference between said noise-unreduced signals and noise-reduced signals obtained at a time of executing noise reduction operations with the preset filter properties set to said filter processing means as a candidate filter property, thereby obtaining a noise reduction effect indicator regarding said candidate filter property, and selecting filter properties to be set to said filter processing means based on said noise reduction effect indicator.

14. A signal processing device comprising:

a filter processing unit configured to execute noise reduction operations by subjecting sound-collected signals from a sound-collecting unit to filtering processing based on preset filter properties and providing signal properties for noise reduction;

a noise-unreduced signal obtaining unit configured to obtain noise-unreduced signals obtained in a state where noise reduction operations by said filter processing unit are stopped; and a filter property selecting unit configured to obtain a difference between said noise-unreduced signals and noise-reduced signals obtained at a time of executing noise reduction operations with the preset filter properties set to said filter processing unit as a candidate filter property, thereby obtaining a noise reduction effect indicator regarding said candidate filter property, and selecting filter properties to be set to said filter processing unit based on said noise reduction effect indicator.

15. A signal processing method comprising the steps of:

obtaining noise-unreduced signals in a state where noise reduction operations by a filter processing unit, which executes the noise reduction operations by subjecting sound-collected signals from a sound-collecting unit to filtering processing based on preset filter properties and providing signal properties for noise reduction, are stopped; and obtaining a difference between said noise-unreduced signals and noise-reduced signals obtained at a time of executing the noise reduction operations with the preset filter properties set to said filter processing unit as a candidate filter property, thereby obtaining a noise reduction effect indicator regarding said candidate filter property, and selecting filter properties to be set to said filter processing unit based on said noise reduction effect indicator.

* * * * *